US009231352B2

(12) United States Patent
Sasaki et al.

(10) Patent No.: US 9,231,352 B2
(45) Date of Patent: Jan. 5, 2016

(54) MODULE, AND CONNECTION STRUCTURE OF MODULE AND MATING CONNECTOR

(71) Applicant: HOSIDEN CORPORATION, Yao-shi (JP)

(72) Inventors: Daisuke Sasaki, Yao (JP); Takayuki Nagata, Yao (JP); Yasuo Nakai, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/456,248

(22) Filed: Aug. 11, 2014

(65) Prior Publication Data

US 2015/0056861 A1 Feb. 26, 2015

(30) Foreign Application Priority Data

Aug. 23, 2013 (JP) ..... 2013-173427

(51) Int. Cl.

| | |
|---|---|
| ***H01R 13/631*** | (2006.01) |
| ***H01R 13/66*** | (2006.01) |
| ***H01R 13/514*** | (2006.01) |
| *H01R 12/70* | (2011.01) |
| *H01R 13/26* | (2006.01) |
| *H01R 13/516* | (2006.01) |

(52) U.S. Cl.

CPC ..... *H01R 13/665* (2013.01); *H01R 13/514* (2013.01); *H01R 13/6315* (2013.01); *H01R 12/7076* (2013.01); *H01R 13/26* (2013.01); *H01R 13/516* (2013.01)

(58) Field of Classification Search

CPC ..... H01R 13/631; H01R 23/6873; H01R 13/65802; H01R 13/639; H01R 13/64

See application file for complete search history.

(56) References Cited

U.S. PATENT DOCUMENTS

| | | | | |
|---|---|---|---|---|
| 4,993,971 | A * | 2/1991 | Matsuzaki et al. | 439/607.35 |
| 6,824,419 | B1 | 11/2004 | Wu | |
| 7,278,885 | B1 * | 10/2007 | Zhang | 439/607.32 |
| 8,142,225 | B2 * | 3/2012 | Yu | 439/607.35 |

(Continued)

FOREIGN PATENT DOCUMENTS

| | | |
|---|---|---|
| EP | 0901197 A2 | 3/1999 |
| EP | 2026423 A2 | 2/2009 |

(Continued)

OTHER PUBLICATIONS

Extended European Search Report issued on Jan. 19, 2015 for the counterpart European patent application No. 14250093.3.

*Primary Examiner* — Gary Paumen

(74) *Attorney, Agent, or Firm* — Kratz, Quintos & Hanson, LLP

(57) ABSTRACT

The invention provides a module being connectable to a mating connector having a tube and including a case and a connector. The case has a through hole that is larger than the tube so as to receive the tube. The connector fits into the tube along a first direction and includes a tuboid shell that includes a lip, first to fourth corners, and guides. The first and second corners are provided where the distal face of the lip meets outer faces on one and the other sides, respectively, of a second direction of the lip. The third and fourth corners are provided where the distal face of the lip meets outer faces on one and the other sides, respectively, of a third direction of the lip. The guides, each at least one of a chamfer, a rounded face, and a curved portion curved inward of the connector, are provided at the respective first to fourth corners.

21 Claims, 16 Drawing Sheets

(56) References Cited

U.S. PATENT DOCUMENTS

| | | | | |
|---|---|---|---|---|
| 8,202,123 | B1 * | 6/2012 | Lin et al. | 439/607.54 |
| 2002/0019154 | A1 * | 2/2002 | Na | 439/76.1 |
| 2003/0096528 | A1 | 5/2003 | Fukamachi | |
| 2006/0030173 | A1 * | 2/2006 | Kawakita et al. | 439/76.1 |
| 2006/0046535 | A1 * | 3/2006 | Iida | 439/76.1 |
| 2006/0079112 | A1 * | 4/2006 | Shuey et al. | 439/374 |
| 2006/0134993 | A1 | 6/2006 | Dawiedczyk et al. | |
| 2008/0207056 | A1 | 8/2008 | Kumamoto et al. | |
| 2010/0267270 | A1 | 10/2010 | Jehmlich et al. | |
| 2012/0040553 | A1 | 2/2012 | Tashiro | |
| 2013/0203290 | A1 * | 8/2013 | Zhang | 439/607.36 |
| 2013/0252466 | A1 * | 9/2013 | Chen | 439/607.35 |
| 2015/0004830 | A1 * | 1/2015 | Gomez et al. | 439/374 |

FOREIGN PATENT DOCUMENTS

| | | | |
|---|---|---|---|
| JP | 07267020 | | 10/1995 |
| JP | 2012-169158 | A1 | 9/2012 |

* cited by examiner

MODULE, AND CONNECTION STRUCTURE OF MODULE AND MATING CONNECTOR

CROSS-REFERENCE TO RELATED APPLICATIONS

The present application claims priority under 35 U.S.C. §119 of Japanese Patent Application No. 2013-173427 filed on Aug. 23, 2013, the disclosure of which is expressly incorporated by reference herein in its entity.

BACKGROUND OF THE INVENTION

1. Technical Field

The invention relates to modules, and connection structures of the modules and mating connectors.

2. Background Art

Japanese Patent Laid-open Publication No. 2012-169158 discloses a connection structure including a module and a mating connector. The module includes a flexible printed circuit (FPC) curved in generally U-shape and an elastic member disposed inside the FPC. The mating connector has a pair of terminals. The FPC and the elastic member are received between distal portions of the terminals, and the FPC elastically contacts the distal portions of the terminals. This establishes connection between the module and the mating connector. For convenience of explanation, the term "connecting direction" refers to the direction into which the FPC and the elastic member are inserted between the distal portions of the terminals.

SUMMARY OF INVENTION

The distal portions of the terminals are bent such that the distance between the distal portions gradually increases toward the distal ends, so that the distal portions of the terminals can guide the FPC and the elastic member therebetween. This arrangement allows the module to be positioned with respect to the mating connector in the aligning direction of the terminals that is orthogonal to the connecting direction. However, this arrangement is not adapted for positioning of the module with respect to the mating connector in the direction orthogonal to the connecting direction and the aligning direction.

There is also a difficulty in connecting the FPC to the circuit board because the FPC needs to be connected to the circuit board with the elastic member disposed inside the FPC. This difficulty should lead to increased cost of the module.

In light of the above circumstances, the invention provides a module including a connector that is readily positionable with respect to a mating connector and can be manufactured at reduced cost. The invention also provides a connection structure of the module and a mating connector.

A first module of the invention is connectable to a mating connector having a tube. The first module includes a case, a circuit board, and a connector. The case has a through hole of larger dimensions than outer dimensions of the tube so as to receive the tube. The circuit board is provided inside the case. The connector is mounted on the circuit board and configured to fit into the tube along a first direction. The connector includes a shell of tuboid shape. The shell includes a lip, a first corner, a second corner, a third corner, a fourth corner, and guides. The first corner is provided where a distal face of the lip meets an outer face on one side of a second direction of the lip. The second direction is substantially orthogonal to the first direction. The second corner is provided where the distal face of the lip meets an outer face on the other side of the second direction of the lip. The third corner is provided where the distal face of the lip meets an outer face on one side of a third direction of the lip. The third direction is substantially orthogonal to the first direction and crossing the second direction. The fourth corner is provided where the distal face of the lip meets an outer face on the other side of the third direction of the lip. The guides are provided at the respective first, second, third, and fourth corners and located inside the through hole of the case. The guides are each at least one of a chamfer, a rounded face, and a curved portion curved inward of the connector.

The first module of this aspect has at least the following technical features and advantages. First, the connector of the first module is readily positionable with respect to the tube of a mating connector. This is because the shell of the connector includes the guides in the first and second corners opposed to each other in the second direction and in the third and fourth corners opposed to each other in the third direction. In other words, the guides are adapted to guide the tube of the mating connector inside the through hole in the four directions—namely, in the one side of the second direction, in the other side of the second direction, in one side of the third direction, and in the other side of the third direction—so as to fit the connector into the tube. Second, the first module can be manufactured at a reduced cost because of a simple structure in which the connector is mounted on the circuit board.

A second module of the invention is connectable to a mating connector having a tube. The second module includes a case, a circuit board, and a connector. The case has a through hole of larger dimensions than outer dimensions of the tube so as to receive the tube. The circuit board is provided inside the case. The connector is mounted on the circuit board and configured to fit into the tube along a first direction. The connector includes a body. The body includes a distal portion, a first corner, a second corner, a third corner, a fourth corner, and guides. The first corner is provided where a distal face of the distal portion meets an outer face on one side of a second direction of the distal portion. The second direction is substantially orthogonal to the first direction. The second corner is provided where the distal face of the distal portion meets an outer face on the other side of the second direction of the distal portion. The third corner is provided where the distal face of the distal portion meets an outer face on one side of a third direction of the distal portion. The third direction is substantially orthogonal to the first direction and crossing the second direction. The fourth corner is provided where the distal face of the distal portion meets an outer face on the other side of the third. direction of the distal portion. The guides are provided at the respective first, second, third, and fourth corners and disposed inside the through hole of the case. The guides are each at least one of a chamfer, a rounded face, and a curved portion curved inward of the connector.

The second module of this aspect has at least the following technical features and advantages. First, the connector of the second module is readily positionable with respect to the tube of a mating connector. This is because the body of the connector includes the guides in the first and second corners of the distal portion of the body opposed to each other in the second direction and in the third and fourth corners of the distal portion opposed to each other in the third direction. In other words, the guides are adapted to guide the tube of the mating connector inside the through hole in the four directions—namely, in the one side of the second direction, in the other side of the second direction, in one side of the third direction, and in the other side of the third direction—so as to fit the connector into the tube. Second, the second module can be manufactured with reduced cost because of a simple structure in which the connector is mounted on the circuit board.

The case may further include first and second inner walls of the through hole that are opposed to each other in the second direction. The guides of the shell or of the body may include first and second guides. The first guide may be located on a side of the first inner wall, and the second guide may be located on a side of the second inner wall. Relative positioning of the first inner wall and the second guide may be such that, when a portion on a side of the first inner wall of a tube of a mating connector abuts the first inner wall, a portion on a side of the second inner wall of the tube can be located on the second guide.

The first and second modules of this aspect are further advantageous in positioning the connector of the module with respect to the tube of the mating connector for the following reason. When inserting the tube of the mating connector into the through hole of the case, merely by bringing the portion on the side of the first inner wall of the tube into abutment with the first inner wall, the portion on the side of the second inner wall of the tube will he disposed on the second guide. Therefore, the portion on the side of the second inner wall of the tube can be readily guided by the second guide to readily fit the connector into the tube.

The case may further include third and fourth inner walls of the through hole that are opposed to each other in the third direction. The guides of the shell or of the body may include further third and fourth guides. The third guide may be disposed on a side of the third inner wall, and the fourth guide may be disposed on aside of the second inner wall. Relative positioning of the third inner wall and the fourth guide may be such that, when a portion on a side of the third inner wall of a tube of a mating connector abuts the third inner wall, a portion on a side of the fourth inner wall of the tube can be located on the fourth guide.

The first and second modules of this aspect are further advantageous in positioning the connector of the module with respect to the tube of the mating connector for the following reason. When inserting the tube of the mating connector into the through hole of the case, merely by bringing the portion on the side of the third inner wall of the tube into abutment with the third inner wall, the portion on the side of the fourth inner wall of the tube will be disposed on the fourth guide. Therefore, the portion on the side of the fourth inner wall of the tube can be readily guided by the fourth guide to readily fit the connector into the tube.

The connector of the first module may further include a body fitting in the shell. The body may include a distal portion, a first corner, a second corner, a third corner, a fourth corner, and guides. The distal portion may be located inside the through hole of the case. The first corner may be provided where a distal face of the distal portion meets an outer face on one side of the second direction of the distal portion. The second corner may be provided where the distal face of the distal portion meets an outer face on the other side of the second direction of the distal portion. The third corner may be provided where the distal face of the distal portion meets an outer face on one side of the third direction of the distal portion. The fourth corner may be provided where the distal face of the distal portion meets an outer face on the other side of the third direction of the distal portion. The guides may be provided at the respective first, second, third, and fourth corners of the body. The guides of the body may each be at least one of a chamfer, a rounded face, and a curved portion curved inward of the connector.

The first module of this aspect is further advantageous in positioning the connector of the module with respect to the tube of the mating connector for the following reason. When the tube of the mating connector is inserted into the through hole of the case, the tube can be guided by the guides of the body of the connector and also by the guides of the shell.

The first and second modules may further include a packing. The packing may be provided at the case and configured to be interposed between the module and the mating connector. The first and second modules of this aspect have improved waterproofness.

The case may further include a first case having the through hole, and a second case welded to the first case. The first and second modules of this aspect can be easily manufactured for the following reason. Since the connector as mounted on the circuit board is connected to the mating connector, there is no need to use a sealing agent for fixing a terminal for connection with the mating connector to the first case. Accordingly, the first and second cases can be fixed to each other by welding, facilitating the manufacture of the first and second modules.

The first and second modules may further include an electronic component mounted on the circuit board. The first and second modules of this aspect, with the electronic component and the connector mounted on the circuit board, can be manufactured with a reduced number of components as compared to the case of connecting the electronic component to the circuit board via a connection member such as an FPC.

The connection structure of the invention includes the first or second module according to any one of the above aspects and a mating connector. The mating connector may include a tube configured to be received in the through hole of the case of the module and to fit with the connector.

The connection structure may further include a fastening mechanism to fasten the mating connector to the case of the module with the connector fitting in the tube of the mating connector.

The fastening mechanism may include a pair of first engaging holes, a pair of second engaging holes, and a pair of engaging portions. The first engaging holes may be made in the case of the module. The second engaging holes may be made in the mating connector. The second engaging holes may communicate with the first engaging holes and be larger in size than the first engaging holes. The engaging parts may be configured to engage with the first and second engaging holes.

in the connection structure of this aspect, even in the case where the connector of the first or second modules is positionally offset from the through hole of the case due to variations within dimensional tolerance or the like, such an offset can be compensated for when connecting the mating connector to the connector of the first or second module. This is because the second engaging hole is larger in size than the first engaging hole and it is therefore easy to position the first engaging hole with respect to the second engaging hole.

The connection structure may further include a packing. The packing may be interposed between the first or second module and the mating connector. The connection structure of this aspect has improved waterproofness.

DESCRIPTION OF EMBODIMENTS

Embodiments 1 and 2 of the invention will be described below.

Embodiment 1

Figure 1:
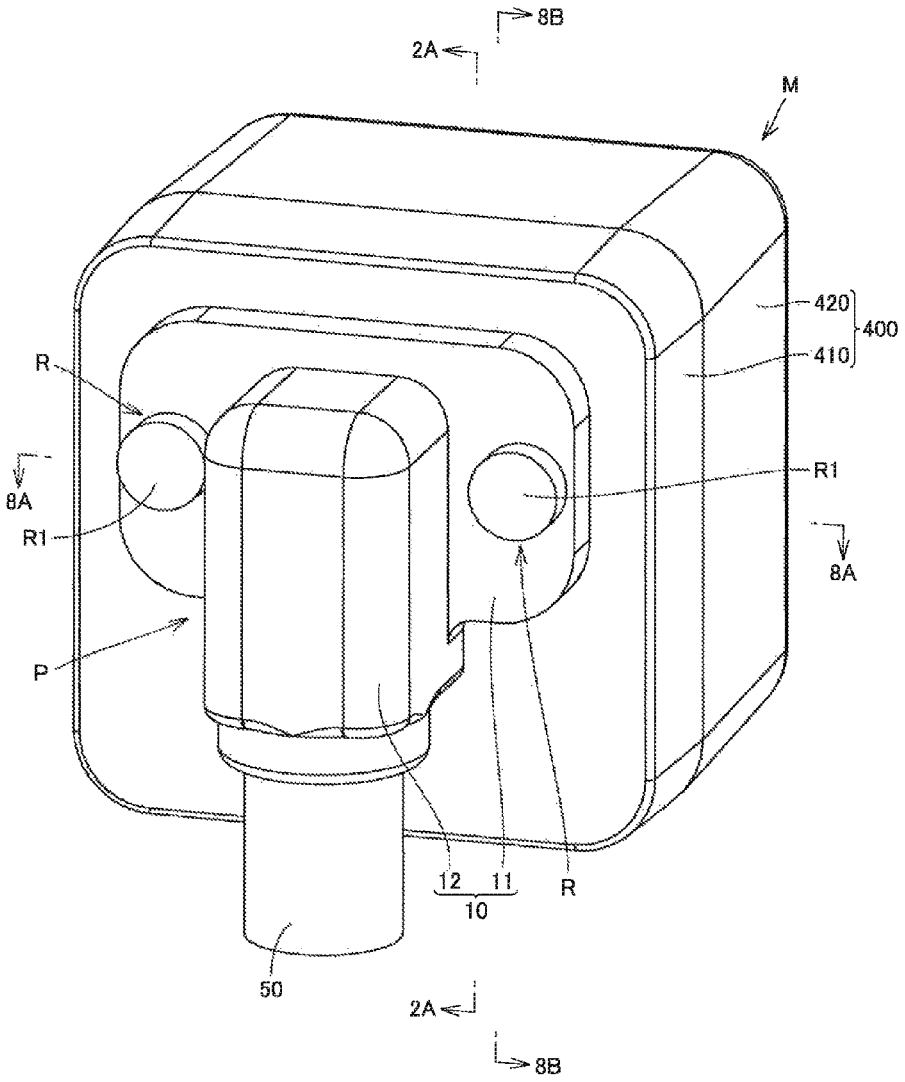
FIG. 1 is a front, top, right side perspective view of a connection structure of a module and a mating connector in accordance with Embodiment 1 of the invention.

First, a connection structure of a module and a mating connector in accordance with Embodiment 1 of the invention will be described with reference to FIG. 1 to FIG. 8B. The connection structure as shown in FIG. 1 includes a module M, a mating connector P, and a fastening mechanism R.

The module M is a component module. The module M will be described with reference to FIGS. 1 to 6. FIGS. 2A, 3, 4A, 4B, 6A, 6B, 8A, and 8B indicate a direction Z-Z', which is the insertion/removal direction of the module M and the mating connector P and corresponds to the "first direction" as defined in the claims. FIGS. 2A, 3, 4A, 6A, 6B, and 8B indicate a direction Y-Y', which is the height direction of the module M and corresponds to the "third direction" as defined in the claims. FIGS. 3, 4B, 6A, 6B, and 8A indicate a direction X-X', which is the width direction of the module M and the mating connector P and corresponds to the "second direction" as defined in the claims. The direction Y-Y' is orthogonal to the direction Z-Z'. The direction X-X' is orthogonal to the direction Y-Y' and the direction Z-Z'. The direction X and the direction X' correspond to the "one side in the second direction" and the "other side in the second direction," respectively, as defined in the claims. The direction Y and the direction Y' correspond to the "one side in the third direction" and the "other side in the third direction," respectively, as defined in the claims.

The module M includes a connector 100, a circuit board 200, an electronic component 300, a case 400, and a packing 500.

Figure 4A:
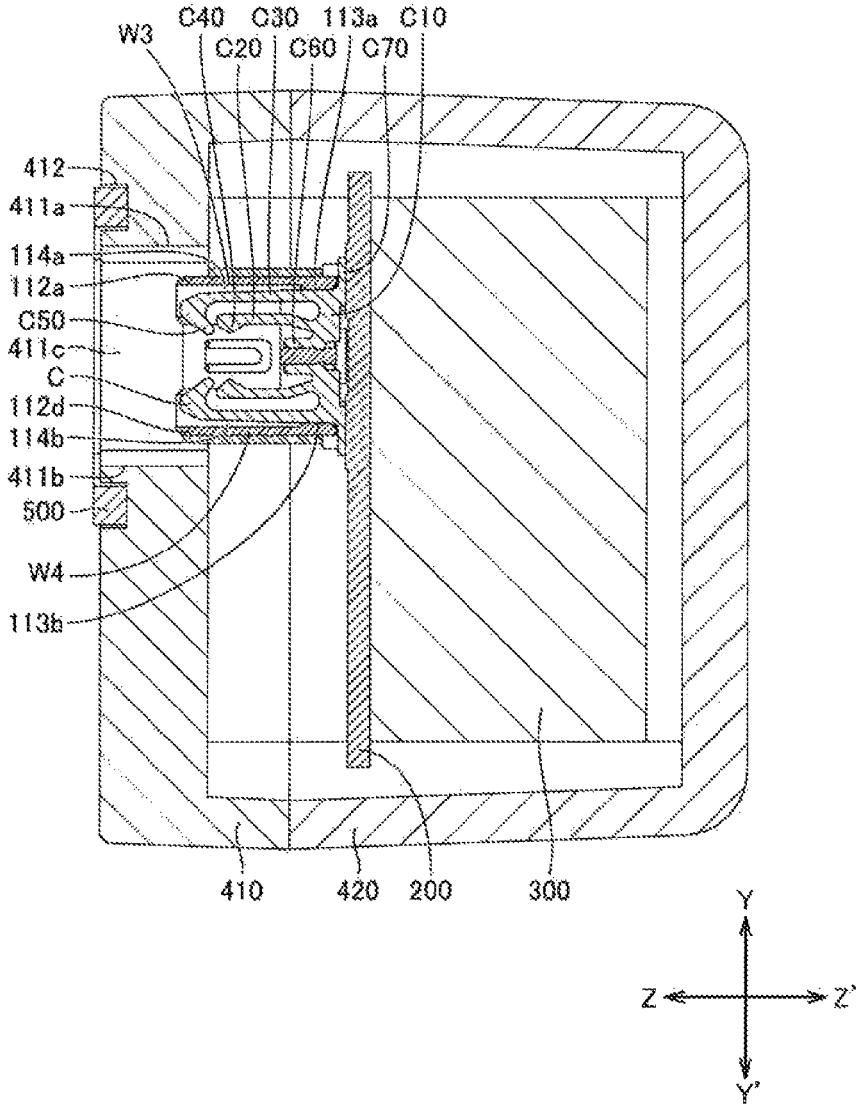
FIG. 4A is a sectional view of the module, taken along 4A-4A in FIG. 3.
Figure 4B:
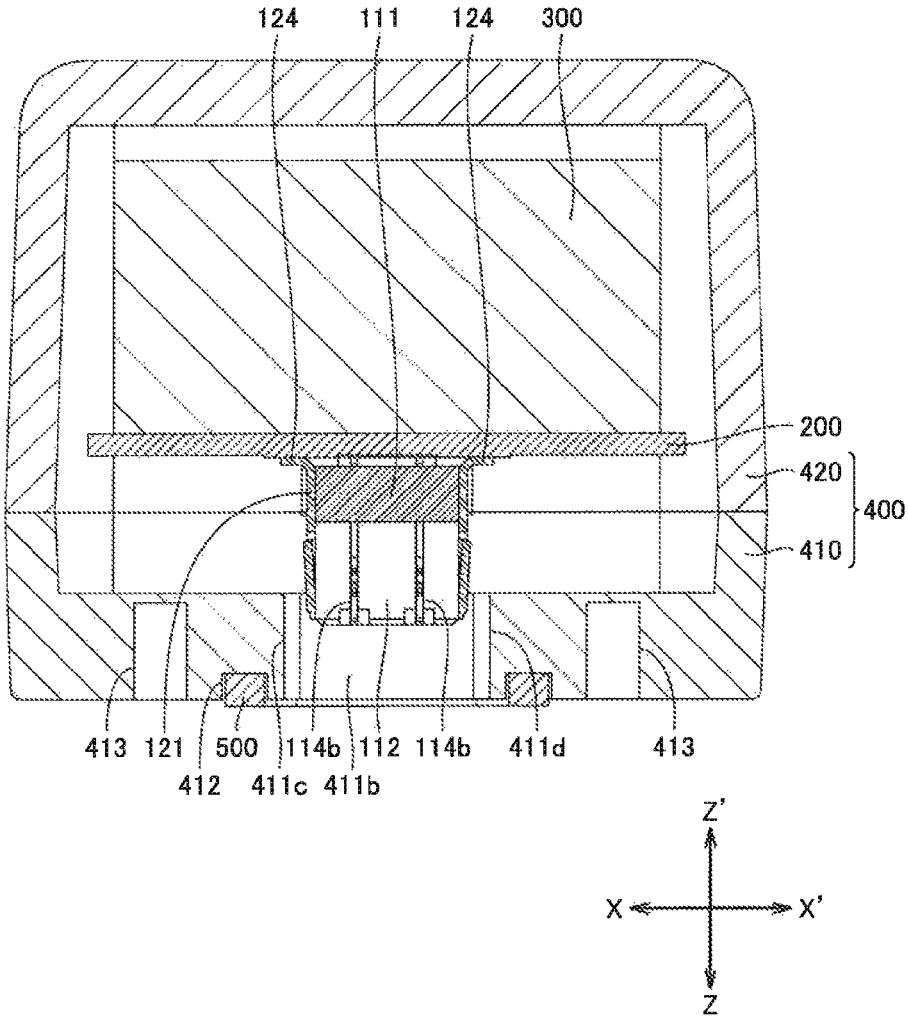
FIG. 4B is a sectional view of the module, taken along 4B-4B in FIG. 3.
Figure 5A:
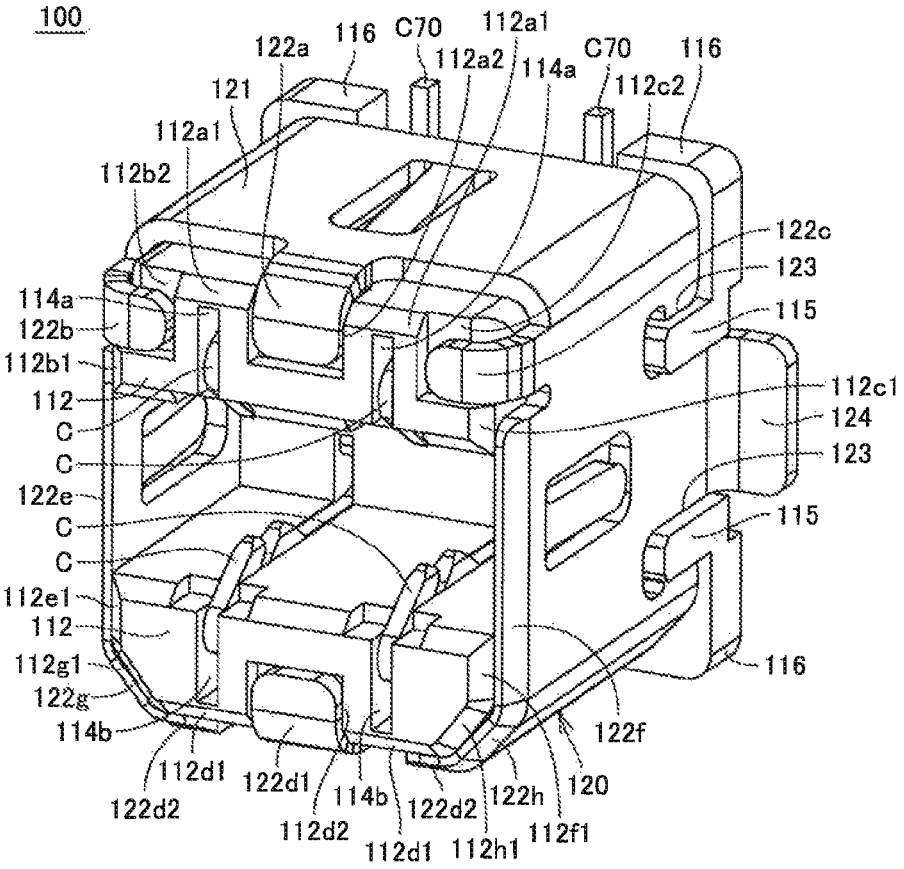
FIG. 5A is a front, top, right side perspective view of a connector of the module.
Figure 5B:
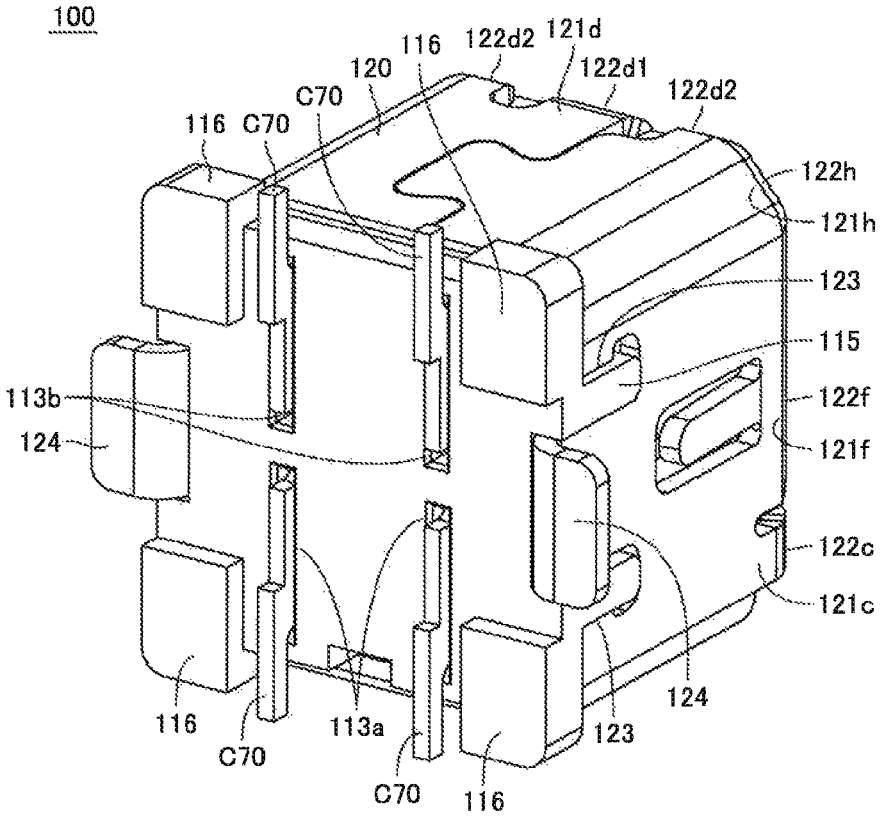
FIG. 5B is a back, bottom, right side perspective view of the connector.

As best illustrated in FIGS. 5A and 5B, the connector 100 is a hexagonal cylindrical connector that can fit into a tube 41 (to be described) of the mating connector P. As shown in FIGS. 2A to 6B, the connector 100 includes a body 110, a shell 120, and a plurality of terminals C.

Figure 6A:
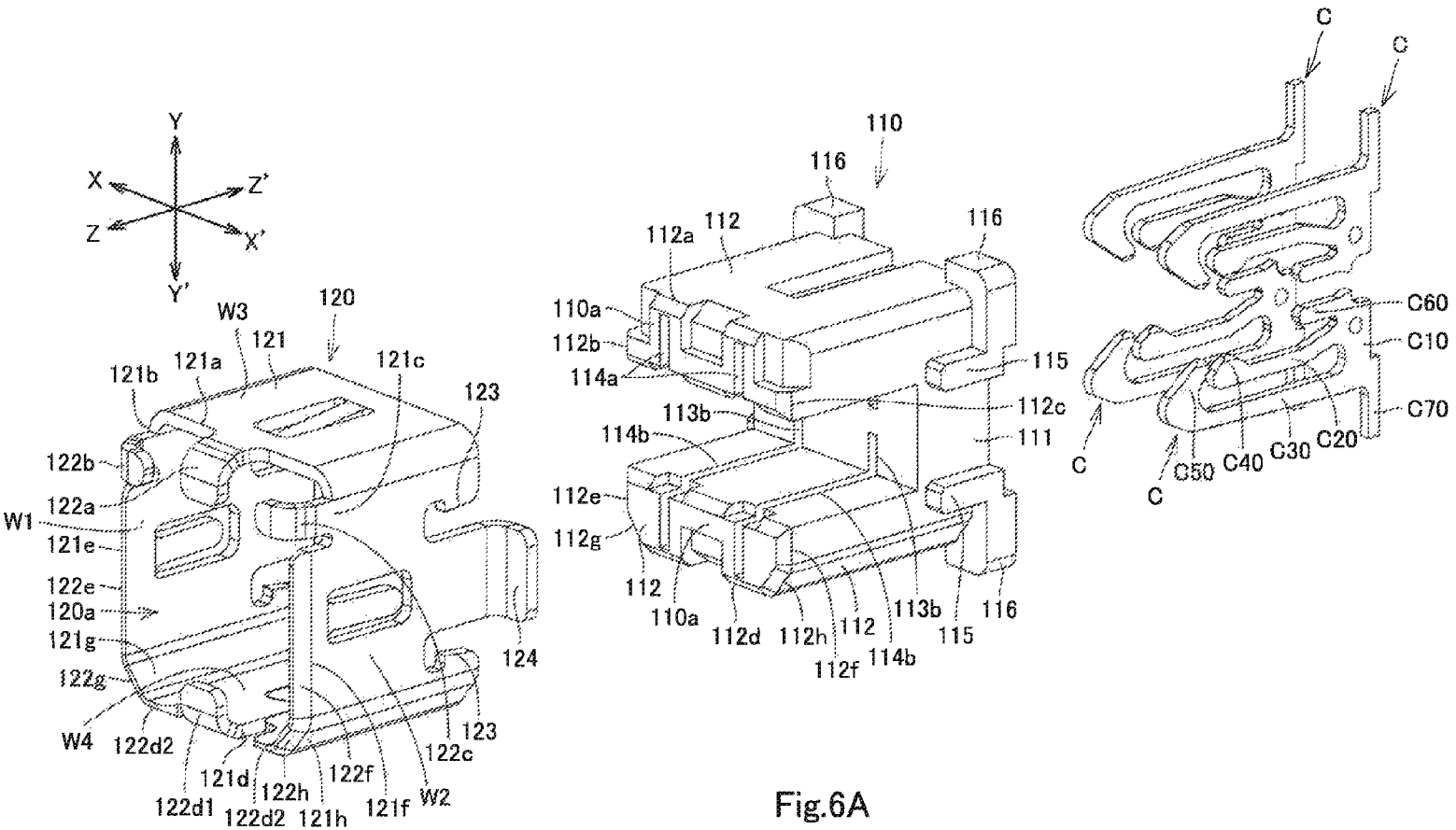
FIG. 6A is an exploded perspective view showing the front, top, right side of the connector.
Figure 6B:
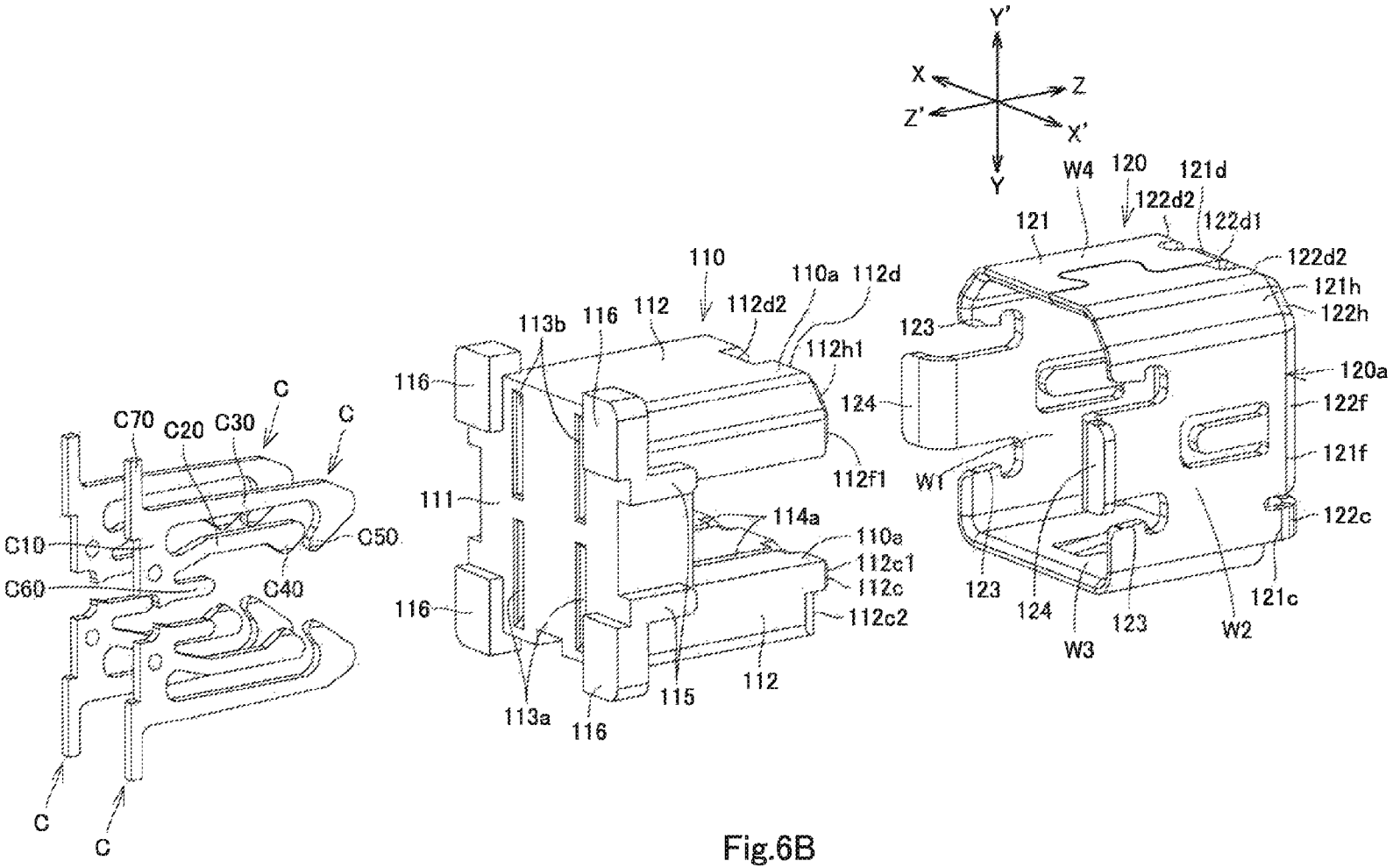
FIG. 6B is an exploded perspective view showing the back, bottom, right side of the connector.

The body 110 is made of insulating resin. As best illustrated in FIGS. 6A and 6B, the body 110 includes a basal portion 111, a pair of tongues 112, a plurality of holding holes 113*a*, 113*b*, a plurality of slits 114*a*, 114*b*, a plurality of engaging protrusions 115, and a plurality of mounts 116. The basal portion 111 is a rectangular block extending in the direction Y-Y'. The basal portion 111 includes a first end on the direction Y side and a second end on the direction Y' side.

One of the tongues 112 (upper tongue in FIG. 6A) is a rectangular plate extending from the first end of the basal portion 111 in the direction Z. The other tongue 112 (lower tongue in FIG. 6A) is a hexagonal cylindrical plate extending from the second end of the basal portion 111 in the direction Z. The upper and lower tongues 112 each include a distal portion 110*a* that is the end portion on the direction-Z-side (i.e. the distal portions 110*a* constitute the distal portion of the body 110). The distal portion 110*a* of the upper tongue 112 includes a corner 112*a*, acorn: 112*b*, and a corner 112*c*. The distal portion 110*a* of the lower tongue 112 includes a corner 112*d*, a corner 112*e*, a corner 112*f*, a corner 112*g*, and a corner 112*h*. The corner 112*a* corresponds to the "third corner" of a body as defined in the claims, the corners 112*b* and 112*c* correspond to the "first corner" of the body as defined in the claims, the corners 112*c* and 112*f* correspond to the "second corner" of the body as defined in the claims, and the corner 112*d* corresponds to the "fourth corner" of the body as defined in the claims.

The corner 112*a* is the corner where the distal face of the upper tongue 112 meets the direction-Y-side outer face of the distal portion 110*a* of the upper tongue 112. As best illustrated in FIG. 5A, the corner 112*a* is provided with a pair of guides 112*a*1 (third guide) spaced in the direction X-X'. The guides 112*a*1 are chamfers sloping down in a direction including components of the directions Z and Y'. A housing recess 112*a*2 is provided between the guides 112*a*1 of the distal portion 110*a* of the upper tongue 112. The corner 112*b* is the corner where the distal face of the upper tongue 112 meets the direction-X-side outer face of the distal portion 110*a* of the upper tongue 112. The corner 112*b* is provided with a guide 112*b*1 (first guide). The guide 112*b*1 is a chamfer sloping down in a direction including components of the directions Z and X'. The corner 112*c* is the corner where the distal face of the upper tongue 112 meets the direction-X'-side outer face of the distal portion 110*a* of the upper tongue 112. The corner 112*c* is provided with a guide 112*c*1 (second guide). The guide 112*c*1 is a chamfer sloping down in a direction including components of the directions Z and X. Housing recesses 112*b*2 and 112*c*2 are provided in the direction-Y-side areas of the guides 112*b*1 and 112*c*1, respectively, of the distal portion 110*a* of the upper tongue 112.

The corner 112*d* is the corner where the distal face of the lower tongue 112 meets the direction-Y'-side outer face of the distal portion 110*a* of the lower tongue 112. The corner 112*d* is provided with a pair of guides 112*d*1 (fourth guide) spaced in the direction X-X'. The guides 112*d*1 are chamfers sloping down in the direction including components of the directions Z and Y. A housing recess 112*d*2 is provided between the guides 112*d*1 of the distal portion 110*a* of the lower tongue 112. The corner 112*e* is the corner where the distal face of the lower tongue 112 meets the direction-X-side outer face of the distal portion 110*a* of the lower tongue 112. The corner 112*e* is provided with a guide 112*e*1 (first guide). The guide 112*e*1 is a chamfer sloping down in a direction including components of the directions Z and X. The corner 112*f* is the corner where the distal face of the lower tongue 112 meets the X'-direction-side outer face of the distal portion 110*a* of the tongue 112. The corner 112*f* is provided with a guide 112*f*1 (second guide). The guide 112*f*1 is a chamfer sloping down in a direction including components of the directions Z and X. The corner 112*g* is the corner where the distal face of the lower tongue 112 meets the direction-X-and-Y'-side outer face of the distal portion 110*a* of the lower tongue 112. The corner 112*g* is provided with a guide 112*g*1. The guide 112*g*1 is a chamfer sloping down in a direction including components of the directions Z, Y, and X. The corner 112*h* is the corner where the distal face of the lower tongue 112 meets the direction-X'-and-Y-side outer face of the distal portion 110*a* of the tongue 112. The corner 112*h* is provided with a guide 112*h*1. The guide 112*h*1 is a chamfer sloping down in a direction including components of the directions Z, Y, and X.

As best illustrated in FIGS. 6A and 6B, the slits 114*a* are arranged in the upper tongue 112 in spaced relation to each other along the direction X-X'. The slits 114*a* are open to the direction Y' side. The slits 114*b* are arranged in the lower tongue 112 in spaced relation to each other along the direction. X-X'. The slits 114*b* are open to the direction Y' side. The slits 114*h* are symmetrically shaped with respect to the slits 114*a*. The holding holes 113*a* are provided in the basal portion 111, in communication with the respective slits 114*a*. The holding holes 113*a* are open to the direction Z'. The holding holes 113*b* are provided in the basal portion 111, in communication with the respective slits 114*b*. The holding holes 113*b* are symmetrically shaped with respect to the holding holes 113*a* and are open to the direction Z'.

As best illustrated in FIGS. 6A and 6B, the mounts 116 are rectangular blocks provided at the respective four corners of the direction Z' end face of the basal portion 111. Two of the engaging protrusions 115, located on the direction X side, are rectangular protrusions on the direction-X-side end face of the basal portion 111, arranged in spaced relation to each other along the direction Y-Y' to extend in the direction Z-Z'. The other two engaging protrusions 115, located on the direction X' side, are rectangular protrusions on the direction-X'-side end face of the basal portion 111, arranged in spaced relation to each other along the direction Y-Y' to extend in the direction Z-Z' from.

As shown in FIGS. 6A and 6B, the terminals C are metal plates. The terminals C each have a base C10, first and second arms C20, C30, first and second contact portions C40, C50, engaging portion C60, and a tail C70. The base C10 is a plate extending in the direction Y-Y'. The first and second arms C20, C30 are plates in spaced relation to each other along the direction Y-Y', extending from the base C10 in the direction Z. The second arm C30 has a larger dimension in the direction Z-Z' than that of the first arm C20. The first and second arms C20, C30 are elastically deformable in their alignment direction (i.e. the direction Y-Y').

The first contact portion C40 is a plate extending from the direction Z end (distal end) of the first arm C20 to one side in the alignment direction (in the direction Y or Y'). In Embodiment 1, the first contact portion C40 extends to one side of the alignment direction (the direction Y or the direction Y'). The second contact portion C50 is a plate extending from the direction-Z end of the second arm C30 to the one side in the alignment direction. The second contact portion C50 is located on the direction-Z side of the first contact portion C40. In Embodiment 1, the second contact portion C50 extends in a direction including components of the one side of the alignment direction and the direction Z'. The distal end on the one side of the alignment direction of the second contact portion C50 is located at substantially the same height in the alignment direction as, or alternatively slightly further in the alignment direction than, the distal end on the one side of the alignment direction of the first contact portion C40.

The engaging portion C60 is a plate extending in the direction Z from the base C10, more particularly from its end on the one side of the alignment direction. The engaging portion C60 includes a protrusion protruding to the one side of the alignment direction. The tail C70 is a plate extending to the other side in the alignment direction from the base C10, more particularly from its end on other side in the alignment direction.

Each terminal C is configured such that the direction Y-Y' dimension from the protrusion of the engaging portion C60 to the end on the other side of the alignment direction of the base C10 is slightly larger than the direction Y-Y' dimension of the associated holding hole 113*a* or 113*b*. As to two of the terminals C (i.e. upper terminals C as shown in FIG. 4A), each terminal C is configured such that the base C10 and the engaging portion C60 are press-fitted and held in the associated holding hole 113*a*, that the first and second arms C20, C30 are accommodated in the associated slit 114*a*, that the distal portions of the first and second contact portions C40, C50 protrude from the associated slit 114*a* to the direction Y' side (downward in FIG. 4A), and that the tail C70 is in contact with the direction-Z'-side end face of the body 110. As to the two remaining terminals (i.e. lower terminals C as shown in FIG. 4A), each terminal C is configured such that the base C10 and the engaging portion C60 are press-fitted and held in the associated holding hole 113*b*, that the first and second arms C20, C30 are accommodated in the associated slit 114*b*, that the distal portions of the first and second contact portions C40, C50 protrude from the associated slit 114*b* to the direction Y side (upward in FIG. 4A), and that the tail C70 is in contact with the direction-T-side end face of the body 110. The first and second contact portions C40, C50 of the upper terminals C are opposed to the first and second contact portions C40, C50 of the lower terminals C. All the terminals C are arranged such that the end faces on the direction Z; side of the tails C70 are located substantially at the same height in the direction Z-Z as the end faces on the direction Z side of the mounts 116 of the body 110'. That is, the tails C70 and the mounts 116 are disposed on the same face of the circuit board 200. The tails C70 are connected to the circuit board 200.

As best illustrated in FIG. 6A and FIG. 6B, the shell 120 is a hexagonal tube formed of a metal plate. The shell 120 includes a shell body 121, guides 122*a* to 122*h*, a plurality of engaging recesses 123, and a pair of legs 124. The shell body 121 is a hexagonal tube. The inner shape of the shell body 121 conforms to the outer shape of the body 110. The body 110 fits in the shell body 121. In other words, the shell body 121 covers the outer periphery of the body 110. The shell body 121 includes a direction-X-side wall W1, a direction-X'-side wall W2, a direction-Y-side wall W3, and a direction-Y'-side wall W4. The direction-X-side wall W1 of the shell body 121, the direction-X'-side wall W2 of the shell body 121, and the tongues 112 of the body 110 define a connection hole of the connector 100. The outer shape of the shell body 121 conforms to the inner shape of the tube 41 (to be described) of the mating connector P. The shell body 121 can fit in the tube 41. As shown in FIG. 4A, the direction-Y-side wall W3 of the shell body 121 extends substantially parallel to the second arms C30 of the upper terminals C. The direction-Y'-side wall W4 of the shell body 121 extends substantially parallel to the second arms C30 of the lower terminals C. In other words, the second arms C30 of the terminals C extend along the direction-Y-side wall W3 or the direction-Y'-side wall W4 to allow for impedance matching of each of the terminals C. This results in matched impedance between the upper terminals C and between the lower terminals C.

The shell body 121 further includes a lip 120*a* on the direction Z side and a lip on the direction Z' side. The direction-Z-side lip 120*a* includes a first portion of generally inverted U-shape, and a second portion that is the remaining portion of generally U-shape. The distal face of the first portion is located further to the direction Z' side (lower side) than the distal face of the second portion, and further to the direction Z' side (lower side) than the direction-Z'-side ends (lower ends) of the guides 112*a*1 of the body 110. The distal face of the second portion is located at substantially the same height in the direction Z-Z' as the direction-Z'-side ends (lower ends) of the guides 112*b*1, 112*c*1, 112*d*1, 112*e*1, 112*f*1, 112*g*1, and the 112*h*1 of the body 110. The first portion includes corners 121*a*, 121*b*, and 121*c*. The second portion includes corners 121*d*, 121*e*, 121*f*, 121*g*, and 121*h*. The corner 121*a* corresponds to the third corner of the shell as defined in the claims, the corners 121*b* and 121*e* correspond to the first corner of the shell in the claims, the corners 121*c* and 121*f* correspond to the second corner of the shell in the claims, and the corner 121*d* corresponds to the fourth corner in the claims.

The corner 121*a* is the corner where the distal face of the first portion of the lip 120*a* meets the direction-Y-side outer face of the first portion. As best illustrated in FIG. 6A, the corner 121*a* includes a guide 122*a* (third guide), which is a curved portion that extends in the direction Z and then curves in the direction Y' (inwards of the connector 100). The distal portion of the guide 122*a* is housed in a housing recess 112*a*2 in the upper tongue 112 of the body 110 (see FIG. 5A). The corner 121*b* is the corner where the distal face of the first portion of the lip 120*a* meets the direction-X-side outer face of the first portion. The corner 121*b* includes a guide 122*b* (first guide), which is a curved portion that extends in the direction Z and then curves in the direction X' (inwards of the connector 100). The distal portion of the guide 122*b* is housed in a housing recess 112*b*2 in the upper tongue 112 of the body 110 (see FIG. 5A). The corner 121*c* is the corner where the distal face of the first portion of the lip 120*a* meets the direction-X'-side outer face of the first portion. The corner 121*c* includes a guide 122*c* (second guide), which is a curved portion that extends in the direction Z and then curves in the direction X (inwards of the connector 100). The distal portion of the guide 122*c* is housed in a housing recess 112*c*2 in the upper tongue 112 of the body 110 (see FIG. 5A).

The corner 121*d* is the corner where the distal face of the second portion of the lip 120*a* and the direction-Y'-side outer face of the second portion. The corner 121*d* is centrally provided with a guide 122*d*1 (fourth guide). The corner 121*d* further includes a pair of guides 122*d*2 (fourth guide), one at either end of the guide 122*d*1. The guide 122*d*1 is a curved portion that extends in the direction Z and then curves in the direction Y (inwards of the connector 100). The distal portion of the guide 122*d*1 is housed in the housing recess 112*d*2 in the lower tongue 112 of the body 110 (see FIG. 5A). The guides 122*d*2 are chamfers sloping down in a direction including components of the directions Z and Y. The guides 122*d*2 are located on the direction Z' side of the guides 112*d*1 of the body 110. The corner 121*e* is the corner where the distal face of the second portion of the lip 120*a* meets the direction-X-side outer face of the second portion. The corner 121*e* includes a guide 122*e* (first guide), which is a chamfer sloping down in a direction including components of the directions Z and X'. The guide 122*e* is located on the direction Z' side of the guides 112*b*1, 112*e*1 of the body 110. The corner 121*f* is the corner where the distal face of the second portion of the lip 120*a* and the direction-X'-side outer face of the second portion. The corner 121*f* includes a guide 122*f* (second guide), which is a chamfer sloping down in a direction including components of the directions Z and X. The guide 122*f* is located on the direction Z' side of the guide 112*c*1, 112*f*1 of the body 110. The corner 121*a* is the corner where the distal face of the second portion of the lip 120*a* meets the outer face on the directions X and Y' side of the second portion. The corner 121*g* includes a guide 122*g*, which is a chamfer sloping down in a direction including components of the directions Z, Y, and X'. The guide 122*g* is located on the direction Z' side of the guide 112*g*1 of the body 110. The corner 121*h* is the corner where the distal face of the second portion of the lip 120*a* meets the outer face on the X' and Y' direction side of the second portion. The corner 121*h* includes a guide 122*h*, which is a chamfer sloping down in a direction including components of the directions Z, Y, and X. The guide 122*h* is located on the direction Z' side of the guide 112*h*1 of the body 110.

Of the engaging recesses 123, the two ones on the direction X side are recesses in the direction-X-side wall W1 of the shell body 121, extending in the direction Z-Z' at spaced relation to each other along the direction Y-Y'. These engaging recesses 123 fit over the respective engaging protrusions 115 on the direction X side. The two engaging recesses 123 on the direction X' side are recesses in the direction-X'-side wall W2 of the shell body 121, extending in the direction Z-Z' at spaced relation to each other along the direction Y-Y'. These engaging recesses 123 fit over the respective engaging protrusions 115 on the direction X' side.

Of the legs 124, the one on the direction X side is provided between the engaging recesses 123 in the direction-X-side wall W1 of the shell body 121 and bent at substantially right angles to the shell body 121. The leg 124 on the direction X' side is provided between the engaging recesses 123 in the direction-X'-side wall W2 of the shell body 121 and bent at substantially right angles to the shell body 121. Both legs 124 are electrically connected to the circuit board 200.

The circuit board 200 is a printed circuit board as best illustrated in FIGS. 4A and 4B. The circuit board 200 includes first and second faces opposite to each other. The connector 100 is mounted on the first face of the circuit board 200. The electronic component 300 is mounted on the second face of the circuit board 200.

The electronic component 300 is an electronic component for automobile, mounted on the first face of the circuit board 200. For example, the electronic component 300 may be a camera unit used to take images of the rear and/or surrounding views of an automobile.

Figure 3:
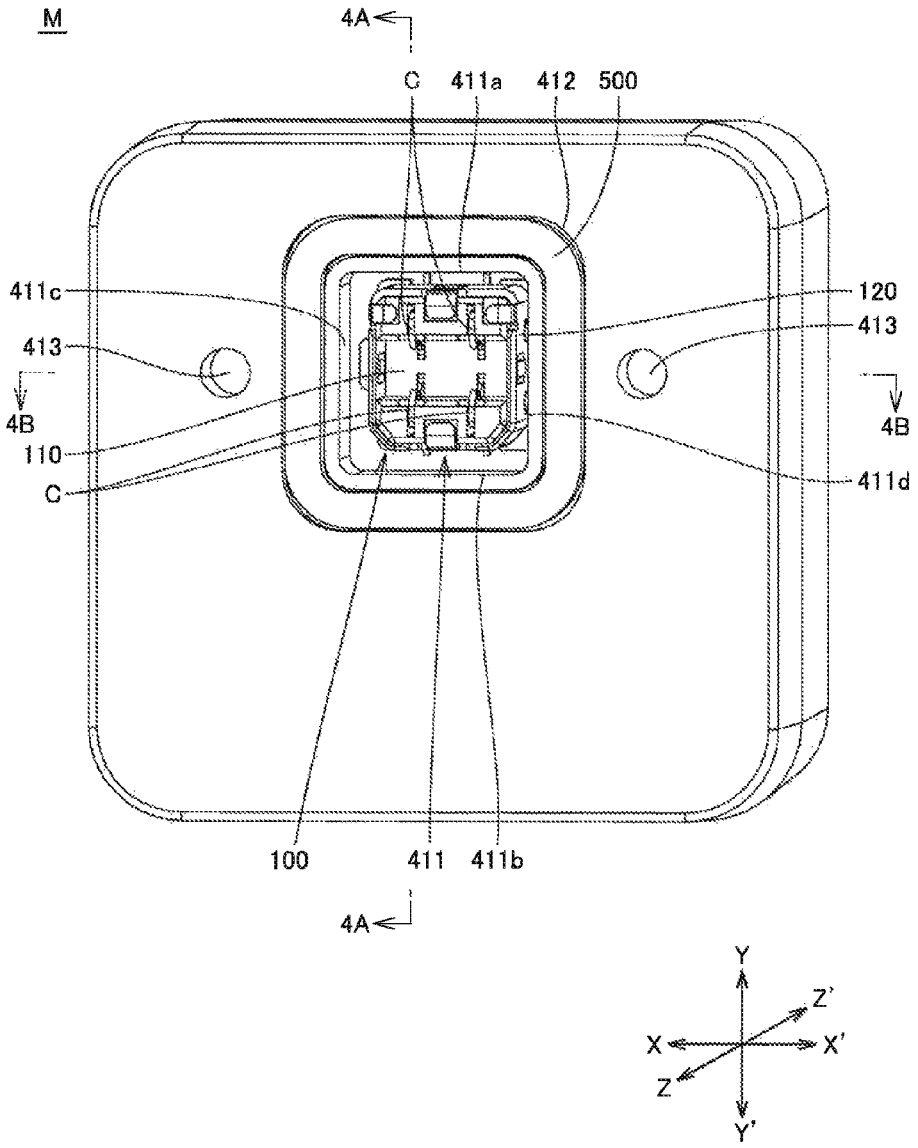
FIG. 3 is a front, top, right side perspective view of the module of the connection structure.

As best illustrated in FIGS. 3 to 4B, the case 400 includes a first case 410 and a second case 420. The first case 410 is a generally rectangular box. The first case 410 includes a bottom and a peripheral wall standing on and along the periphery of the bottom. The bottom of the first case 410 is provided therethrough with a rectangular through-hole 411. The through-hole 411 has larger dimensions than the outer dimensions of the connector 100 and than the outer dimensions of the tube 41 (to be described) of the mating connector P. The through-hole 411 includes inner walls 411*a*, 411*b* (third and fourth inner walls) opposed to each other in the direction Y-Y' and inner walls 411*c*, 411*d* (first and second inner walls) opposed to each other in the direction X-X' The inner wall 411*a* is adjacent and spaced apart from the guides 112*a*1 of the body 110 and the guide 122*a* of the shell 120 of the connector 100. The inner wall 411*b* is adjacent and spaced apart from the guides 112*d*1 of the body 110 and the guides 122*d*1, 122*d*2 of the shell 120 of the connector 100. The inner wall 411*c* adjacent and spaced apart from the guides 112*b*1, 112*e*1 of the body 110 and the guides 122*b*, 122*e* of the shell 120 of the connector 100. The inner wall 411*d* is adjacent and spaced apart from the guide 112*c*1, 112*f*1 of the body 110 and the guides 122*c*, 122*f* of the shell 120 of the connector 100.

Figure 8A:
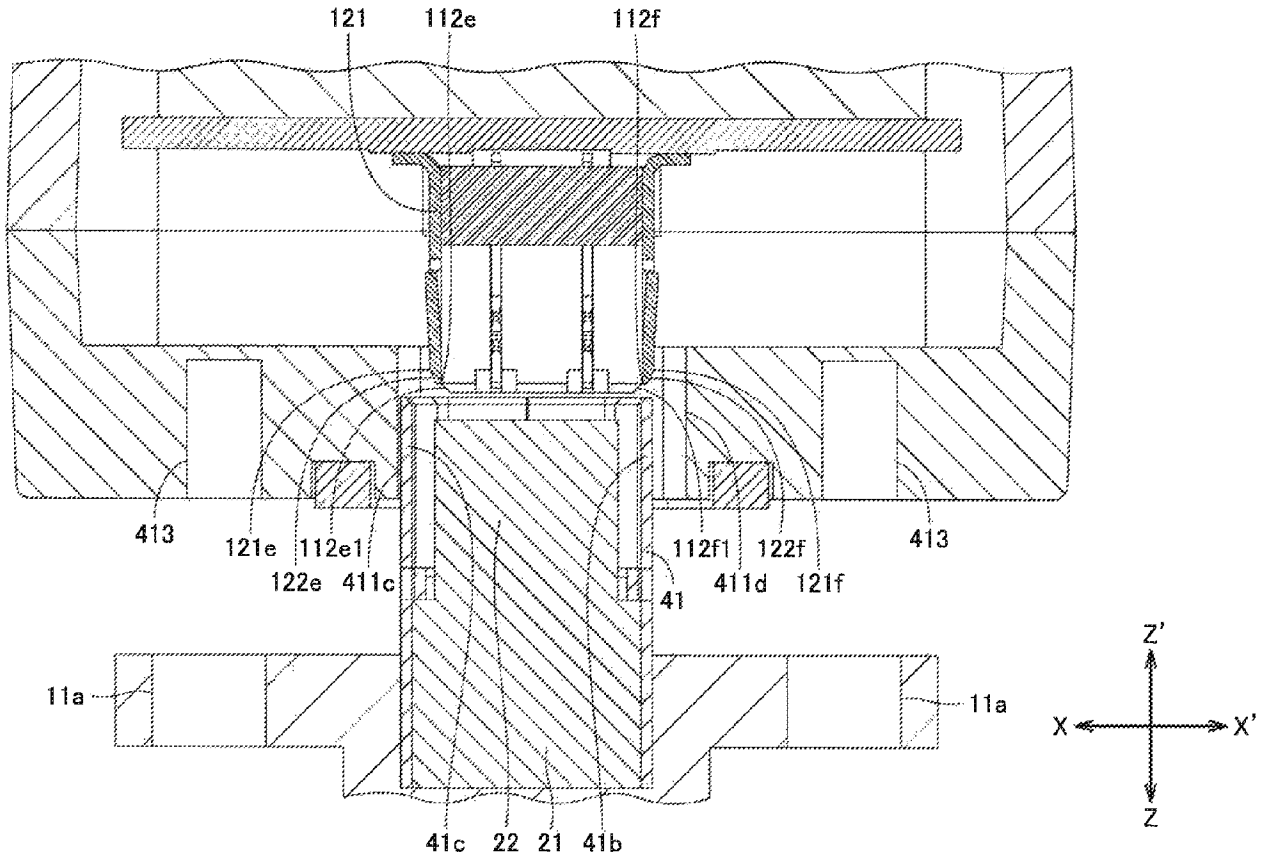
FIG. 8A is a sectional view illustrating a connection process of the module and the mating connector in the connection structure, taken along 8A-8A in FIG. 1.

In the module M, the relative positioning of the first inner wall (inner wall 411*c*) with respect to the second guide (the guides 112*c*1, 112*f*1 of the body 110 and the guides 122*c*, 122*f* of the shell 120) is such that, as shown in FIG. 8A, when the tube 41 (to be described) abuts the first inner wall at its wall 41*c* (a portion on the side of the first inner wall), its wall 41*b* (a portion on the side of the second inner wall) can be located on the second guide. Also in the module M, the relative positioning of the second inner wall (inner wall 411*d*) with respect to the first guide (the guides 112*b*1, 112*e*1 of the body 110 and the guides 122*b*, 122*c* of the shell 120) is such that when the tube 41 abuts the second inner wall at its wall 41*b* (the portion on the side of the second inner wall), its wall 41*c* (the portion on the side of the first inner wall) can be located on the first guide. Also in the module M, the relative positioning of the third inner wall (inner wall 411*a*) and the fourth guide (the guides 112*d*1 of the body 110 and the guides 122*d*1, 122*d*2 of the shell 120) is such that, as shown in FIG. 80, when the tube 41 abuts the third inner wall at its wall 41*a* (a portion on the side of the third inner wall), its wall 41*d* (a portion on the side of the fourth inner wall) can be located on the fourth guide. Also in the module M, the relative positioning of the fourth inner wall (inner wall 411*b*) and the third guide (the guides 112*a*) of the body 110 and the guide 122*a* of the shell 120) is such that when the tube 41 abuts the fourth inner wall at its wall 41*d* (the portion on the side of the fourth inner wall), its wall 41*a* (the portion on the side of the third inner wall) of the tube 41 can be located on the third guide.

As best illustrated in FIG. 3, a ring-shaped recess 412 is provided around the through-hole 411 in the bottom of the first case 410. In other words, the through-hole 411 is provided inside the recess 412. The recess 412 is adapted to receive a ring-shaped packing 500. The thickness of the packing 500 is larger than the depth of the recess 412, so that the packing 500 protrudes at its direction-Z end from the recess 412. A pair of cylindrical engaging holes 413 (first engaging holes) are formed on the direction X side and on the direction X' side in the recess 412 of the bottom of the first case 410.

The second case 420 is a generally rectangular box to be combined with the first case 410 in the direction Z-Z'. The second case 420 includes a bottom and a peripheral wall standing on and along the periphery of the bottom. The peripheral wall of the second case 420 is welded to the peripheral wall of the first case 410. The combined first and second cases 410, 420 provide inner space to house the connector 100, the circuit board 200, and the electronic component 300. The circuit board 200 is affixed to at least one of the first and second cases 410, 420 such that the distal portions 110*a* of the tongues 112 of the body 110 of the connector 100 and the second portion of the direction-Z-side lip 120*a* of the shell 120 are located inside the through-hole 411 of the first case 410. The circuit board 200 will be hereinafter described as fixed to the second case 420.

The module M as described above may be assembled in the following steps. For convenience of description, the electronic component 300 will be described as a camera module. First, the connector 100 may be assembled as follows. The body 110 and the plurality of terminals C are prepared. Two of the terminals C are pressed into the respective holding holes 113*a* of the body 110. The bases C10 and the engaging portions C60 of the terminals C are thus held in the respective holding holes 113*a*. Also, the first and second contact portions C40, C50 of the terminals C are received in the respective slits 114*a*, and the distal portions of the first and second contact portions C40, C50 protrude from the respective slits 114*a*. That is, the distal portions of the first and second contact portions C40, C50 are located in the connection hole of the connector 100. The first and second arms C20, C30 of the terminals C are housed in the respective slits 114*a*. Similarly, the remaining terminals C are inserted into the holding holes 113*b* and the slits 114*b* of the body 110 to be attached to the body 110. Next, the shell 120 is prepared and fitted over the body 110. Then, the guides 122*a*, 122*b*, and 122*c* are accommodated in the housing recesses 112*a*2, 112*b*2, and 112*c*2 of the body 110, respectively. The second arms C30 of the terminals C are disposed along the direction-Y-side wall W3 or the direction-Y'-side wall W4 of the shell 120.

Next, this assembled connector 100, the circuit board 200, and the electronic component 300 are prepared. The electronic component 300 is mounted on the second face of the circuit board 200, and the connector 100 is mounted on the first face of the circuit board 200. The tails C70 of the terminals C of the connector 100 are connected to associated electrodes on the first face of the circuit board 200, and the legs 124 of the shell 120 are soldered to ground electrodes on the first face of the circuit board 200.

The second case 420 is also prepared. Accommodated into the second case 420 are the circuit board 200, the electronic component 300, and the connector 100, with the second face of the circuit board 200 facing the bottom of the second case 420. The circuit board 200 is affixed to the second case 420 such that the center of an imaging device (for example, CCD, CMOS or the like) of the electronic component 300 is aligned with the optical axis of a lens (not shown) provided in the second case 420. The first case 410 is also prepared and combined with the second case 420. Specifically, the peripheral wall of the first case 410 is confronted with the peripheral wall of the second case 420. Upon combining the first and second cases 410, 420, the distal portion (the distal portions 110*a* of the tongues 112 of the body 110 and the second portion of the direction-Z-side lip 120*a* of the shell 120 collectively) of the connector 100 is disposed into the through-hole 411 of the first case 410. Then, the guides 112*a*1 of the body 110 of the connector 100 and the guide 122*a* of the shell 120 are disposed on the side of the inner wall 411*a* in the through-hole 411; the guides 112*d*1 of the body 110 of the connector 100 and the guides 122*d*1, 122*d*2 of the shell 120 are disposed on the side of the inner wall 411*b* in the through-hole 411; the guides 112*b*1, 112*e*1 of the body 110 of the connector 100 and the guides 122*b*, 122*e* of the shell 120 are disposed on the side of the inner wall 411*c* in the through-hole 411; and the guides 112*c*1, 112*f*1 of the body 110 of the connector 100 and the guides 122*c*, 122*f* of the shell are disposed on the side of the inner wall 411*d* in the through-hole 411. Finally, the peripheral wall of the first case 410 is welded to the peripheral wall of the second case 420. The module M is now assembled.

Figure 7A:
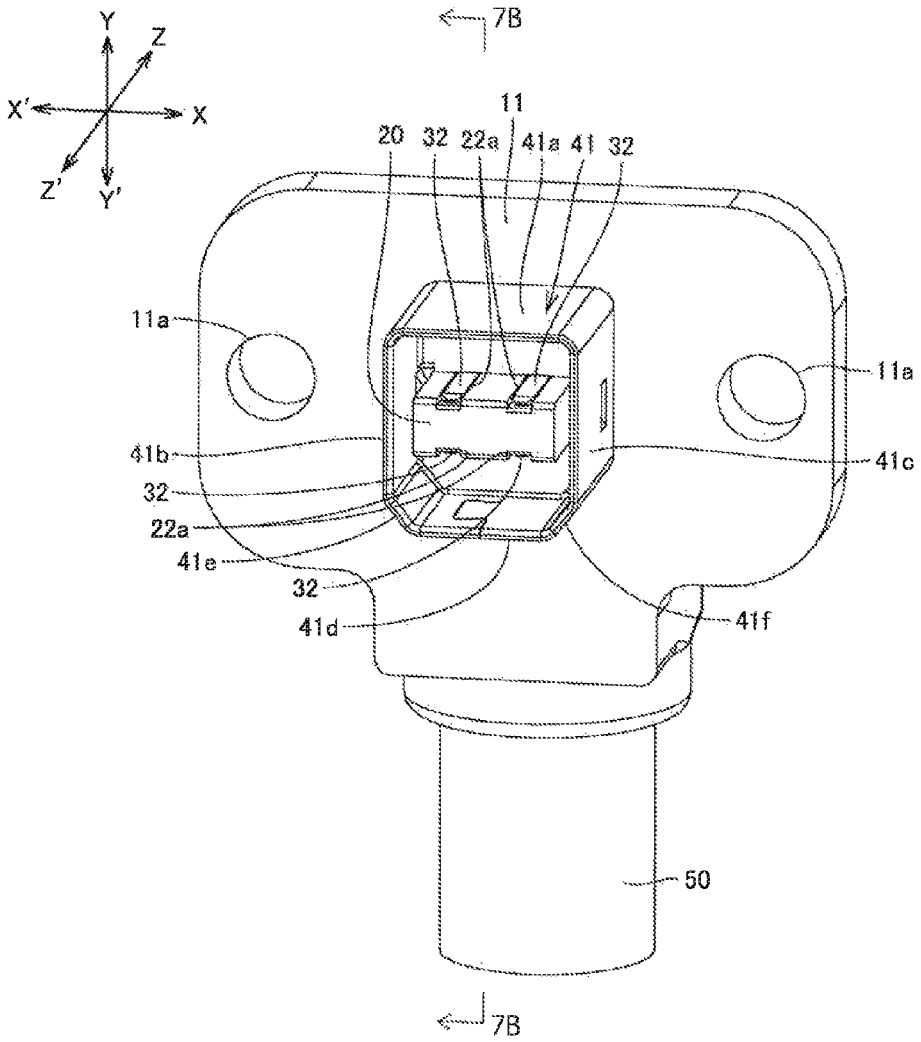
FIG. 7A is a back, top, left side perspective view of the mating connector.
Figure 7B:
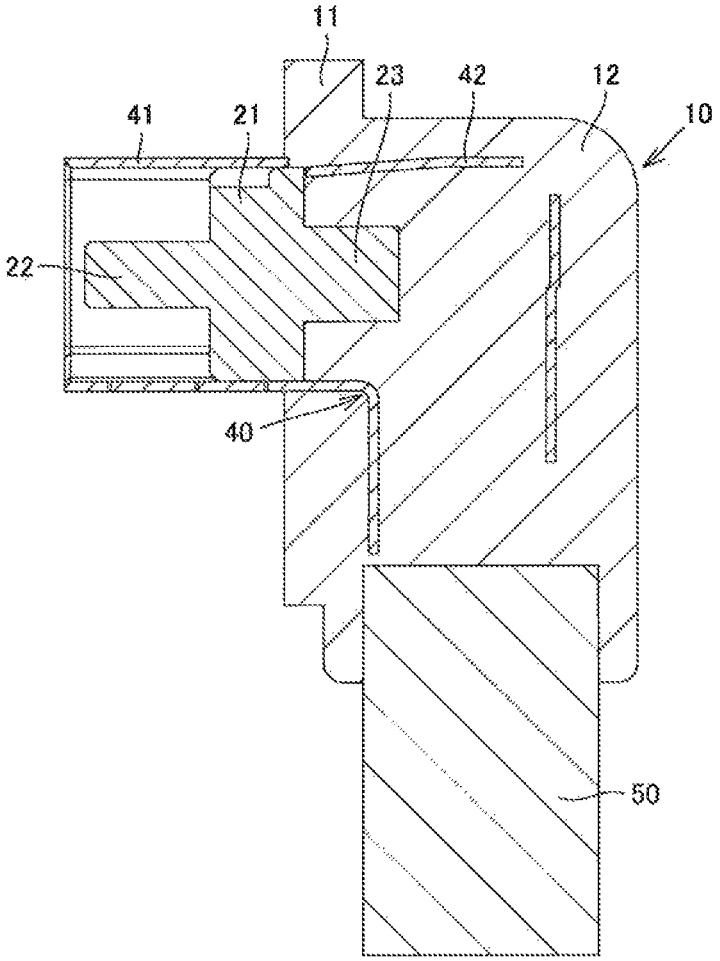
FIG. 7B is a sectional view of the mating connector, taken along 7B-7B in FIG. 7A.

Next, the mating connector P will be described below with reference to FIGS. 7A and 7B. The mating connector P includes a molded part 10, a body 20, a plurality of terminals 30, a shield case 40, and a cable 50.

The body 20 is made of insulating resin. As best illustrated in FIG. 7B, the body 20 includes a base 21, a protrusion 22, and a support 23. The base 21 is a rectangular plate extending in the direction Y-Y' The protrusion 22 is a plate that is provided the direction-T-side end face of the base 21 and extends in the direction Z'. The protrusion 22 has an outer shape conforming to the shape of the connection hole of the connector 100 of the module M, so that protrusion 22 is insertable into the connection hole. As shown in FIG. 7A, the direction-Y-side face of the protrusion 22 has a pair of grooves 22*a* spaced apart from each other in the direction X-X'. The direction-Y'-side face of the protrusion 22 also has a pair of grooves 22*a* spaced apart from each other in the direction X-X'. The support 23 is a plate on the direction-Z-side end face of the base 21, extending in the direction Z.

Figure 2A:
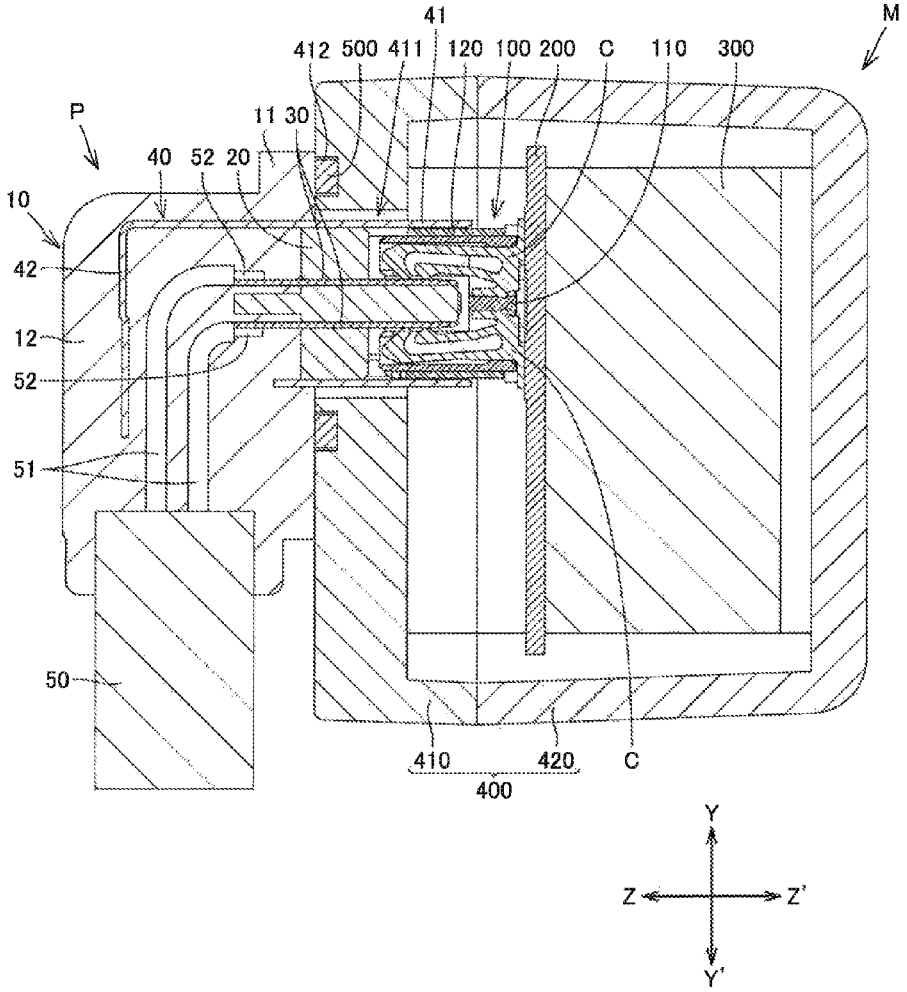
FIG. 2A is a sectional view of the connection structure, taken along 2A-2A in FIG. 1.
Figure 2B:
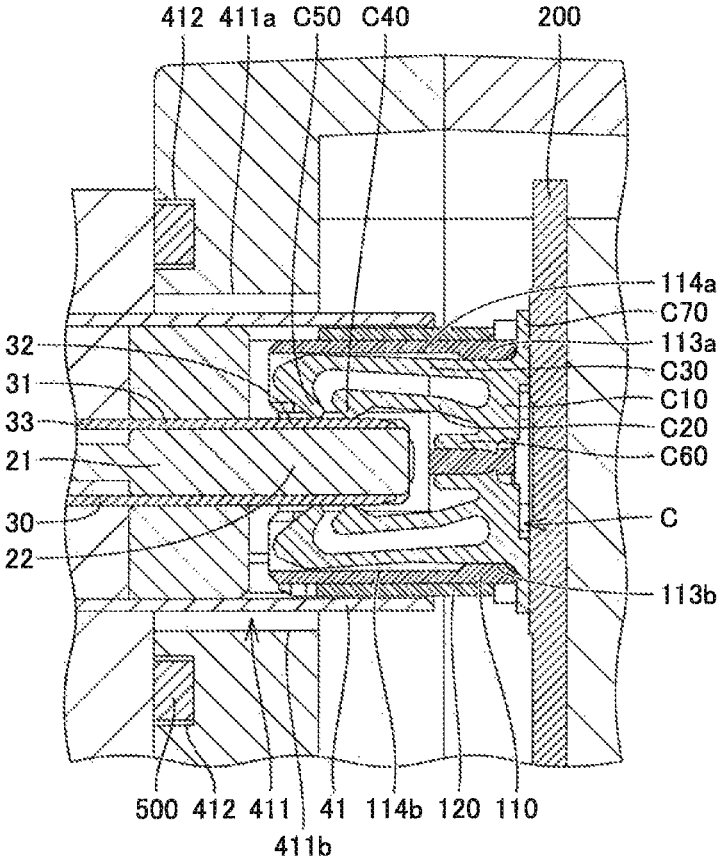
FIG. 2B is a partially enlarged view of the connection structure as illustrated in FIG. 2A.

As best illustrated in FIG. 2B, the terminals 30 are metal plates extending in the direction Z-Z'. The terminals 30 each have an intermediate portion 31, a contact portion 32, and a connecting portion 33. The intermediate portions 31 are held in the base 21 of the body 20. The contact portions 32 extend in the direction-Z' from the direction-Z'-side ends of the intermediate portions 31 to be received in the respective grooves 22*a* of the protrusion 22 of the body 20 (see also FIG. 7A). The connecting portions 33 extend in the direction-Z from direction-Z-side ends of the intermediate portions 31 and are disposed on the support 23 of the body 20.

As best illustrated in FIG. 2A, the cable 50 includes a plurality of signal wires 51 and an outer insulator covering the signal wires 51. Each of the signal wires 51 includes a core wire 52 and an inner insulator covering the core wire 52. A lengthwise end portion of each signal wire 51 protrudes from the outer insulator. A lengthwise end portion of each core wire 52 protrudes from the end portion of the signal wire 51. The protruded portions of the core wires 52 are soldered to the associated connecting portions 33 of the terminals 30.

The shield case 40, as best illustrated in FIG. 2A, is formed of a metal plate. The shield case 40 includes the tube 41 and a cover 42. The tube 41 is a hexagonal tube having an inner shape conforming to the outer shape of the connector 100. The tube 41 fittingly receives the base 21 of the body 20 and accommodates the protrusion 22 and the contact portions 32 of the terminals 30. The tube 41 is adapted to be received in the through-hole 411 of the case 400 of the module M to fit over the connector 100. The tube 41 includes the walls 41*a*, 41*b*, 41*c*, 41*d*, 41*e*, and 41*f*. The wall 41*a* is a wall on the direction Y side of the tube 41. The wall 41*b* is a wall on the direction X' side of the tube 41. The wall 41*c* is a wall on the direction X side of the tube 41. The wall 41*d* is a wall on the direction Y' side of the tube 41. The wall 41*e* is a wall on a direction X' and Y' side of the tube 41. The wall 41*f* is a wall on a direction X and Y' side of the tube 41. The cover 42 is a generally L-shaped plate contiguous with the tube 41 in sectional view. The cover 42 covers the support 23 of the body 20, the connecting portions 33 of the terminals 30, and the above-mentioned end portions of the signal wires 51 of the cable 50.

The molded part 10 is insulating resin that is filled around and inside the cover 42. The molded part 10 includes a tab 11 and a body 12. The body 12 is a rectangular parallelepiped block made of insulating resin, and extends in the direction (direction Y-Y') substantially vertical to the length direction of the tube 41 (direction Z-Z'). Embedded in the body 12 are the support 23 of the body 20, the connecting portions 33 of the terminals 30, the end portions of the signal wires 51 of the cable 50, and the cover 42. This embedding may be given by insert molding, potting, or any other means that renders the mating connector P waterproof. The tab 11 surrounds the body 12. The tab 11 includes a pair of engaging holes 11*a* at positions corresponding to the engaging holes 413 of the case 400 of the module M. As shown in FIG. 8A, the engaging holes 11*a* are larger in diameter than the engaging holes 413.

The fastening mechanism R includes the pair of engaging holes 413 (first engaging holes) of the case 400 of the module M, the pair of engaging holes 11*a* (second engaging holes) of the molded part 10 of the mating connector P, and a pair of pins R1 (engaging part (see FIG. 1)). The pins R1 are engageable with the engaging holes 11*a* and the engaging holes 413.

Figure 8B:
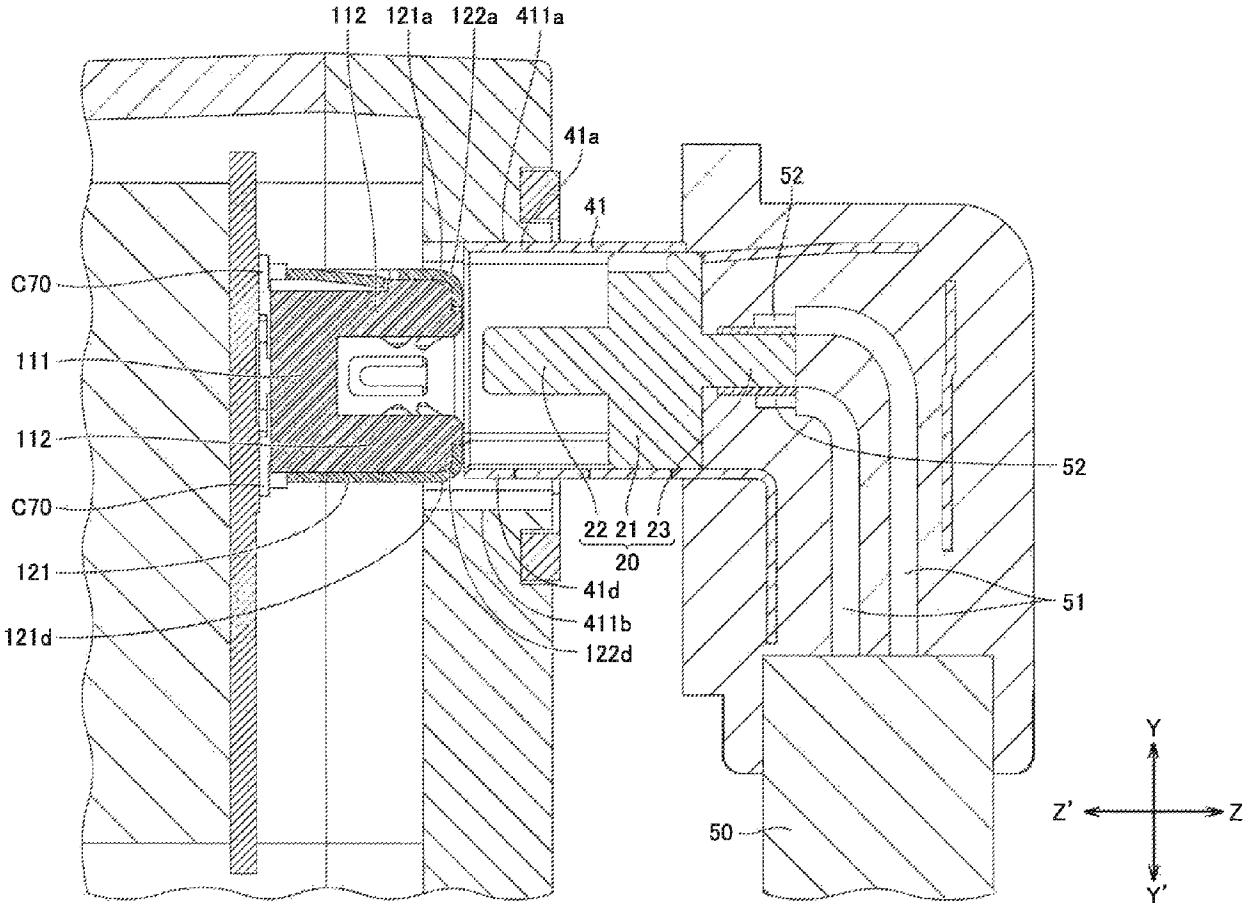
FIG. 8B is a sectional view illustrating a connection process of the module and the mating connector in the connection structure, taken along 8B-8B in FIG. 1.

The mating connector P as described above may be connected to the module M in the following manner. The tube 41 of the mating connector P can be smoothly inserted into the through-hole 411 of the case 400 of the module M in any of the following manners (1)-(4). (1) If the wall 41*a* of the tube 41 is brought into abutment with the inner wall 411*a* of the through-hole 411 as shown in FIG. 8B, the wall 41*d* of the tube 41 is disposed near the guides 112*d*1 of the body 110 and the guides 122*d*1, 122*d*2 of the shell 120 of the module M. Upon further inserting the tube 41 of the mating connector P into the through-hole 411 of the case 400 of the module M, the wall 41*d* of the tube 41 is brought into contact with and guided on the guides 112*d*1 of the body 110 and the guides 122*d*1, 122*d*2 of the shell 120 of the module M. The connector 100 is thus fitted into the tube 41 and the mating connector P is connected to the connector 100 of the module M, specifically in the following arrangement. The protrusion 22 of the body 20 of the mating connector P is received in the connection hole of the connector 100, and the contact portions 32 of the terminals 30 of the mating connector P are in abutment with the first and second contact portions C40, C50 of the terminals C of the connector 100; the first and second contact portions C40, C50 are pressed by the contact portions 32 (i.e. subjected to load) to elastically deform in the direction away from the contact portions 32 (i.e. in the alignment direction of the first and second arms C20, C30); and the pressed first and second contact portions C40, C50 are in contact with the contact portions 32 with a predetermined contact pressure.

(2) If the wall 41*d* of the tube 41 is brought into abutment with the inner wall 411*b* of the through-hole 411, the wall 41*a* of the tube 41 is disposed near the guides 112*a*1 of the body 110 and the guide 122*a* of the shell 120 of the module M. Upon further inserting the tube 41 of the mating connector P into the through-hole 411 of the case 400 of the module M, the wall 41*a* of the tube 41 is brought into abutment with and guided on the guides 112*a*1 of the body 110 and the guide 122*a* of the shell 120 of the module M. The connector 100 is thus fitted into the tube 41 and the mating connector P is connected to the connector 100 of the module M, specifically in the above-described arrangement.

(3) If the wall 41*c* of the tube 41 is brought into abutment with the inner wall 411*c* of the through-hole 411 as shown in FIG. 8A, the wall 41*b* of the tube 41 is disposed near the guides 112*c*1, 112*f*1 of the body 110 and the guides 122*c*, 122*f* of the shell 120 of the module M. Upon further inserting the tube 41 of the mating connector P into the through-hole 411 of the case 400 of the module M, the wall 41*b* of the tube 41 is brought into abutment with and guided on the guides 112*c*1, 112*f*1 of the body 110 and the guides 122*c*, 122*f* of the shell 120 of the module M. The connector 100 is thus fitted into the tube 41 and the mating connector P is connected to the connector 100 of the module M, specifically in the above-described arrangement.

(4) If the wall 41*b* of the tube 41 is brought into abutment with the inner wall 411*d* of the through-hole 411, the wall 41*c* of the tube 41 is disposed near the guides 112*b*1, 112*e*1 of the body 110 and the guides 122*b*, 122*e* of the shell 120 of the module M. Upon further inserting the tube 41 of the mating connector P into the through-hole 411 of the case 400 of the module M, the wall 41*c* of the tube 41 is brought into abutment with and guided on the guides 112*b*1, 112*e*1 of the body 110 and the guides 122*b*, 122*e* of the shell 120 of the module M. The connector 100 is thus fitted in the tube 41 and the mating connector P is connected to the connector 100 of the module M, specifically in the above-described arrangement.

When the mating connector P is connected to the connector 100 of the module M, the engaging holes 11*a* of the tab 11 of the mating connector P communicate with the engaging holes 413 of the case 400 of the module M. Then, by engaging the pins R1 with the engaging holes 11*a* and the engaging holes 413, the mating connector P is fastened to the case 400 as connected to the module M. The packing 500 is thereby held and compressed between the case 400 of the module M and the molded part 10 of the mating connector P. It is described above that the assembly of the module M includes aligning the center of the imaging device (e.g. CCD, CMOS, or the like) of the electronic component 300 with the optical axis of the lens (not shown) in the second case 420. This alignment may result in a slight positional offset of the connector 100 from the desirable position in the through-hole 411 of the first case 410. When the connector 100 is connected to a mating connector P, the engaging holes 11*a* of the tab 11 of the mating connector P will be accordingly offset from the desirable positions for communication with the engaging holes 413 of the case 400 of the module M. Specifically, the center axes of the engaging holes 11*a* are offset from the center axes of the engaging holes 413. However, this offset is unlikely to cause the engaging holes 413 to be blocked by the peripheral area of the engaging holes 11*a* because the engaging holes 11*a* have larger diameters than those of the engaging holes 413. Therefore, even if there is a positional offset as described above during the assembly, the engaging holes 413 can engage the engaging holes 11*a* with the pins R1 without difficulty.

The connection structure as described above has the following technical features and advantages. First, the connector 100 of the module M can be readily positioned with respect to the tube 41 of the mating connector P for the following reasons. When inserting the tube 41 of the mating connector P into the through-hole 411 of the case 400 of the module M, the tube 41 can be guided inside the through hole 411, by the guides 112*h*1, 112*e*1, 122*b*, and 112*e* of the connector 100 in the X direction, by the guides 112*c*1, 112*f*1, 122*c*, and 112*f* of the connector 100 in the X direction, by the guides 112*a*1 and 122*a* of the connector 100 in the Y direction, and/or by the guides 112*d*1, 122*a*1, and 122*a*2 of the connector 100 in the Y' direction.

Second, the tube 41 can be readily positioned with respect to the guides of the connector 100. Specifically, when inserting the tube 41 into the through-hole 411, the tube 41 can be positioned in any of the following manners (1)-(4). (1) By bringing the wall 41*a* of the tube 41 on the Y direction into abutment with the inner wall 411*a* of the through hole 411, the wall 41*d* on the Y' direction side is positioned with respect to and therefore guidable by the guides 112*d*1, 122*d*1, and 122*d*2. (2) By bringing the wall 41*d* of the tube 41 on the Y' direction side into abutment with the inner wall 411*b* of the through hole 411, the wall 41*a* on the Y direction side is positioned with respect to and therefore guidable by the guides 112*a*1, 122*a*. (3) By bringing the wall 41*c* of the tube 41 on the X direction side into abutment with the inner wall 411*c* of the through hole 411, the wall 41*b* on the X' direction side is positioned with respect to and therefore guidable by the guides 112*c*1, 112*f*1, 122*e*, and 122*f*. (4) By bringing the wall 41*b* of the tube 41 on the X' direction side into abutment with the inner wall 411*d* of the through hole 411, the wall 41*c* on the X direction side is positioned with respect to and therefore guidable by the guides 112*b*1, 112*e*1, 122*b*, and 122*e*.

Third, the module M can be manufactured at reduced cost for the following reasons. The module M has a simple configuration that the connector 100 is mounted on the first face of the circuit board 200 and the electronic component 300 is mounted on the second face of the circuit board 200. Moreover, the module M does not require any sealing agent, so that the first and second cases 410, 420 can be welded together. This facilitates the assembly of the module M.

Fourth, the connection structure provides an improved waterproofness. This is because the module M is connected to the mating connector P such that the case 400 of the module M and the mold 10 of the mating connector P holds therebetween the packing 500. Fifth, the connection structure also provides an improved reliability electrical connection for the following reasons. Both the first and second contact portions C40, C50 of each terminal C are adapted to contact the associated terminal 30 of the mating connector P. The first and second contact portions C40, C50 are aligned in the direction Z-Z'. Therefore, even if the mating connector P is offset from the module M in the direction Z-Z', it is more likely that at least one of the first and second contact portions C40, C50 is kept in contact with the associated terminal 30 of the mating connector P. In addition, the first and second arms C20, C30 of the terminals C have different lengths and therefore have different natural vibration frequencies. Thus, even when the connection structure is under vibration conditions, the first and second arms C20, C30 vibrate in different manners, increasing the possibility of maintaining the contact between at least one of the first and second contact portions C40, C50 and the terminal 30 of the mating connector P.

Embodiment 2

Figure 9A:
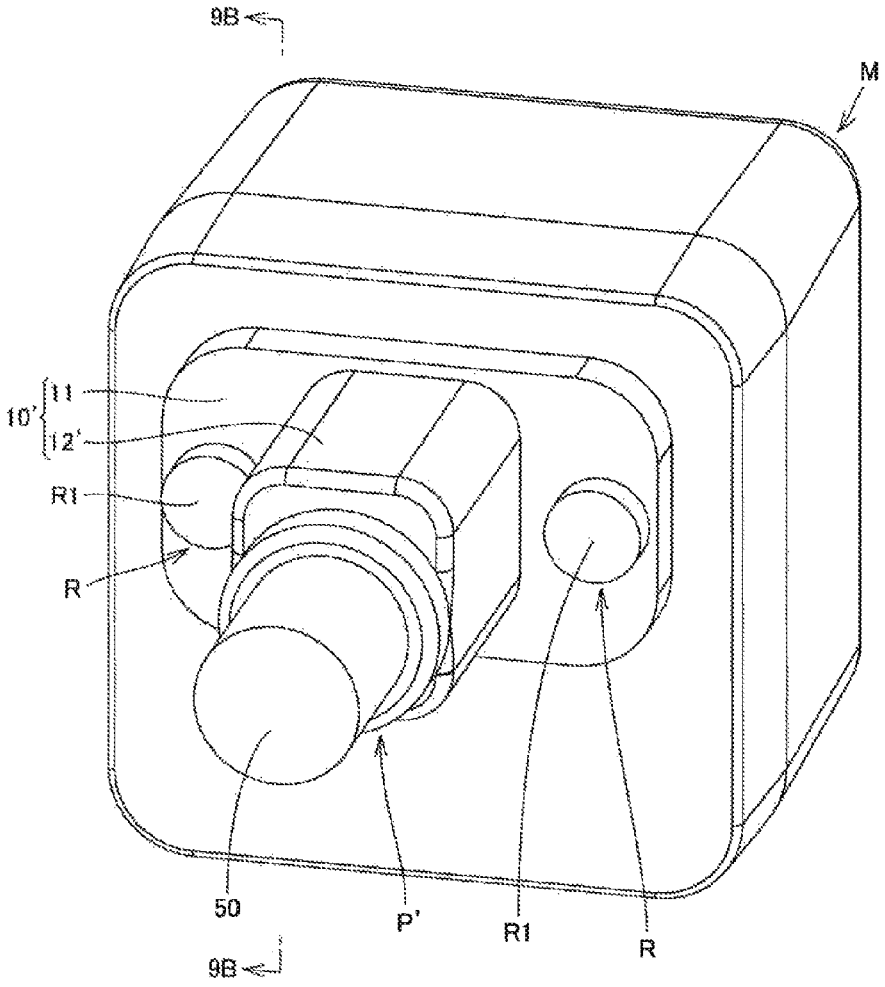
FIG. 9A is a front, top, right side perspective view of a connection structure of a module and a mating connector in accordance with Embodiment 2 of the invention.
Figure 9B:
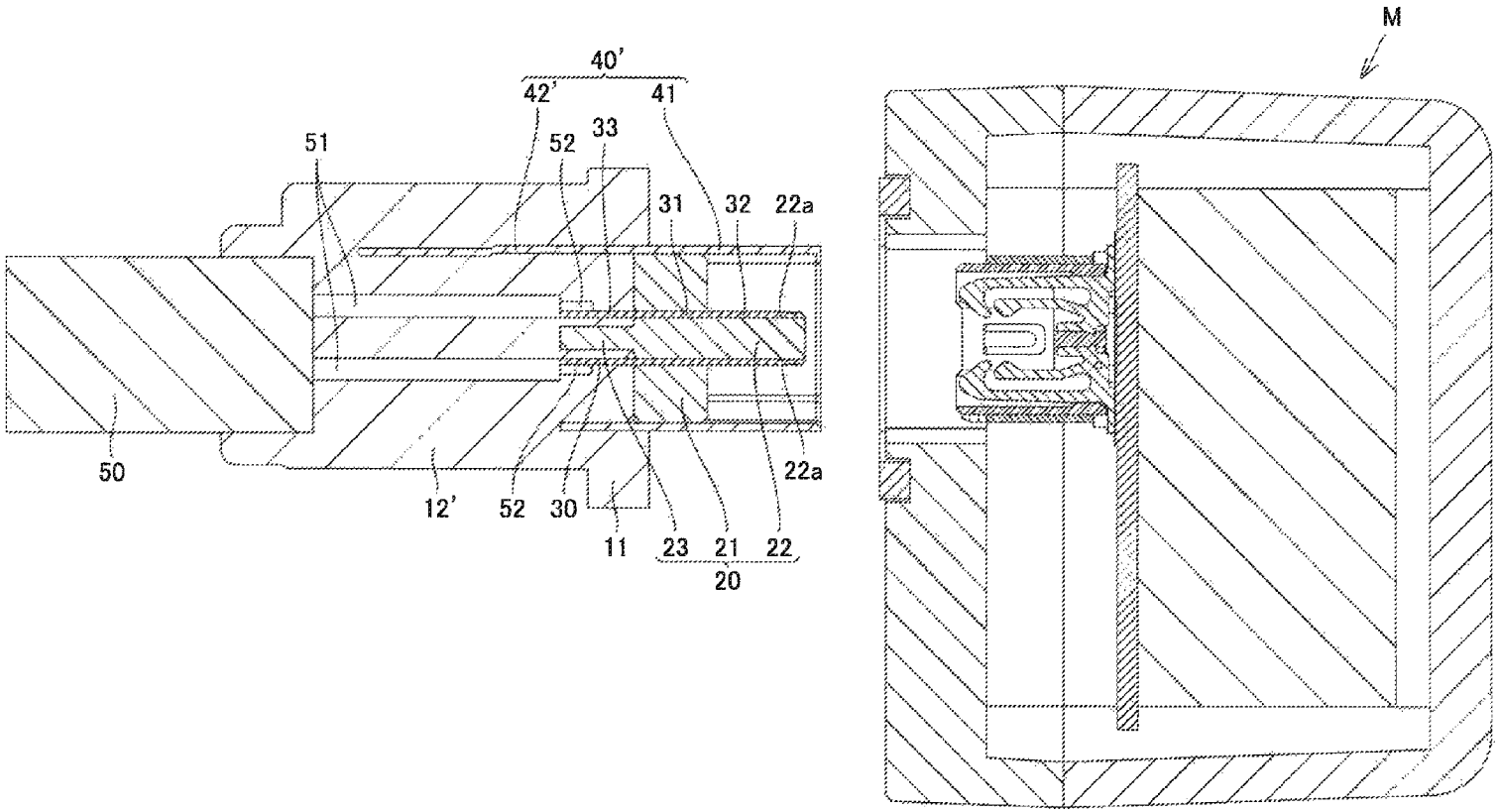
FIG. 9B is a sectional view of the connection structure illustrating the state before the module is connected to the mating connector, taken along 9B-9B in FIG. 9A.

A connection structure of the module and the mating connector in accordance with Embodiment 2 of the invention will be described below with reference to FIGS. 9A to 9B. The connection structure shown in FIGS. 9A and 9B has the same configuration as the connection structure in Embodiment 1, except that a mating connector P' has a different configuration from the mating connector P of Embodiment 1. Only the differences will be described below in detail, and overlapping descriptions will be omitted. A prime symbol (') is added to reference numerals for the mating connector and some of its elements to distinguish them from the mating connector and its elements of Embodiment 1.

The mating connector P' includes the same configuration as the mating connector P except the following differences. The body 12' of the molded part 10' is of different shape from the body 12 of the molded part 10. The cover 42' of the shield case 40' is of different shape from the cover 42 of the shield case 40.

More particularly, the cover 42' is contiguous with the tube 41 and extends in the direction Z-Z'. The cover 42° covers the support 23 of the body 20, the connecting portions 33 of the terminals 30, and the end portions of the signal wires 51 of the cable 50. The body 12' is a rectangular parallelepiped block of insulating resin extending in the length direction of the tube 41 ((i.e. the direction Z-Z'). Embedded in the body 12' are the support 23 of the body 20, the connecting portions 33 of the terminals 30, the end portions of the signal wires 51 of the cable 50, and the cover 42'.

The mating connector P' described above can be connected to the module M in the same manner as the mating connector P of Embodiment 1. Therefore, the connection structure of the mating connector P' and the module M of this embodiment provides substantially the same technical features and advantages as the connection structure of the mating connector P and the module M of Embodiment 1.

The module and the connection structure described above are not limited to the above Embodiments but may be modified in any manner within the scope of the claims. Specific modifications will be described below in detail.

The connector of the module of the invention may be any connector that is mountable on a circuit board, configured to fit into a tube of a mating connector along a first direction, and includes at least one of a shell or a body as described below. For example, the connector may include a shell, a body fitting in the shell, and a terminal held in the body. Alternatively, the connector may include a body and a terminal held in the body. That is, the shell may be omitted.

The shell of the connector of the invention may be of any configuration that meets the following conditions. First, the shell is tuboid. Second, the shell includes a lip on the distal side; first, second, third, and fourth corners as described below; and guides as described below. For example, the shell may be a metal tube of polygonal or circular tuboid shape. Further, the lip of the shell of the invention may or may not include first and second portions. That is, the lip of the shell of the invention may take any tuboid shape corresponding to the shape of the shell. For example, the lip may be a tube of polygonal or circular tuboid shape. Even in the case where the shell is of circular tuboid shape or of polygonal tuboid shape other than the hexagonal tuboid shape as in Embodiments 1 and 2, the lip of the invention may have first and second portions of different heights at their distal faces.

The first corner of the shell of the connector of the invention may be any portion where a distal face of the above-described lip meets an outer face on one side of a second direction, substantially orthogonal to the first direction, of the lip. The second corner of the shell of the invention may be any portion where the distal face of the above-described lip meets an outer face on the other side of the second direction of the lip. The third corner of the shell of the invention may be any portion where the distal face of the above-described lip meets an outer face on one side of a third direction of the lip. The fourth corner of the shell of the invention may be any portion where of the distal face of the above-described lip meets an outer face on the other side of the third direction of the lip. If the shell is of circular tuboid shape, the shell includes a ring-shaped corner where the ring-shaped distal face of the lip of the shell meets the circular tubular outer face of the lip. Such a ring-shaped corner can include first to fourth corners. Particularly, the first corner may be a partial region on one side of the second direction of the ring-shaped corner (a region where the distal face of the lip meets a portion on one side of the second direction of the outer face of the lip), the second corner may be a partial region on the other side of the second direction of the ring-shaped corner (a region where the distal face of the lip meets a portion on the other side of the second direction of the outer face of the lip), the third corner may be a partial region one side of the third direction of the ring-shaped corner (a region where the distal face of the lip meets a portion on one side of the third direction of the outer face of the lip), and the fourth corner may be a partial region on the other side of the third direction of the ring-shaped corner (a region where the distal face of the lip meets a portion on the other side of the third direction of the outer face of the lip).

The guides of the shell of the connector of the invention may be of any configuration that meets the following conditions. First, the first, second, third, and fourth corners as described above are each provided with a guide or guides. Second, the guides are located inside the through hole of the case. Third, the guides are each at least one of a chamfer, a rounded face, and a curved portion curved inward of the connector. For example, if the lip of the shell is a polygonal tuboid, the lip may be provided with a guide or guides at each corner where the distal face of the lip meets the outer face of each side of the lip. These guides may also each be at least one of a chamfer, a rounded face, and a curved portion curved inward of the connector. If the lip of the shell is of circular tubular shape with a ring-shaped corner where the ring-shaped distal face of the lip meets the circular tubular outer face of the lip, the corner may be provided with a ring-shaped chamfer, a ring-shaped rounded face, or a ring-shaped curved portion curved inward of the connector. In this case, the guides may be chamfers, rounded faces, or curved portions curved inward of the connector provided in the first to fourth corners, wherein the first corner may be a partial region on the one side of the second direction of the ring-shaped corner, the second corner may be a partial region on the other side of the second direction of the ring-shaped corner, the third corner may be a partial region one side of the third direction of the ring-shaped corner on, and the fourth corner may be a partial region on the other side of the third direction of the ring-shaped corner. In other words, the guides of the shell of the connector of the invention may be partial regions of the ring-shaped chamfer, rounded face, or curved portion.

The body of the connector of the invention may be of any shape adapted to hold the terminal and fit in the shell. In the case where the shell is omitted, the body of the connector of the invention may be of any shape adapted to hold the terminal and fit in the tube of the mating connector. The body of the connector of the invention may have a distal portion; first, second, third, and fourth corners as described below; and guides as described below. The distal portion of the body may not be located inside the through hole.

The first corner of the body of the connector of the invention may be any portion where a distal face of the distal portion of the body meets an outer face on one side of the second direction, substantially orthogonal to the first direction, of the distal portion. The second corner of the body of the connector of the invention may be any portion where the distal face of the distal portion of the body meets an outer face on the other side of the second direction of the distal portion. The third corner of the body of the connector of the invention may be any portion where the distal face of the distal portion of the body meets an outer face on one side of the third direction, substantially orthogonal to the first direction and crossing the second direction, of the distal portion. The fourth corner of the body of the connector of the invention may be any portion where the distal face of the distal portion of the body meets an outer face on the other side of the third direction of the distal portion. If the body is of circular columnar or circular tubular shape, the body has a ring-shaped corner where the circular or ring-shaped distal face of the distal portion of the body meets the circular tubular outer face of the distal portion. Such a ring-shaped corner can include first to fourth corners. Particularly, the first corner may be a partial region on the one side of the second direction of the ring-shaped corner (a region where the distal face of the distal portion meets a portion on the one side of the second direction of the outer face of the distal portion), the second corner may be a partial region on the other side of the second direction of the ring-shaped corner (a region where the distal face of the distal portion meets the outer face on the other side of the second direction of the distal portion), the third corner may be a partial region on the one side of the third direction of the ring-shaped corner (a region where the distal face of the distal portion meets the outer face on the one side of the third direction of the distal portion), and the fourth corner may be a partial region on the other side of the third direction of the ring-shaped corner (a region where the distal face of the distal portion meets the outer face on the other side of the third direction of the distal portion).

The guides of the body of the connector of the invention may be of any configuration that meets the following conditions. First, the first, second, third, and fourth corners as described above are each provided with a guide or guides. Second, the guides are located inside the through hole of the case. Third, the guides are each at least one of a chamfer, a rounded face, and a curved portion curved inward of the connector. For example, if the body is of polygonal column or polygonal tubular shape, the body may be provided with a guide or guides at each corner where the distal face of the distal portion of the body meets an outer face of each side of the distal portion. These guides may also each be at least one of a chamfer, a rounded face, and a curved portion curved inward of the connector. When the body is of circular columnar or circular tubular shape with a ring-shaped corner where the circular or ring-shaped distal face of the distal portion of the body meets the circular tubular outer face of the distal portion, the corner may be provided with a ring-shaped chamfer, a ring-shaped rounded face, or a ring-shaped curved portion curved inward of the connector. In this case, the guides may be chamfers, rounded faces, or curved portions curved inward of the connector provided in the first to fourth corners, wherein the first corner may be a partial region on the one side of the second direction of the ring-shaped corner, the second corner may be a partial region on the other side of the second direction of the ring-shaped corner, the third corner may be a partial region one side of the third direction of the ring-shaped corner, and the fourth corner may be a partial region on the other side of the third direction of the ring-shaped corner. In other words, the guides of the body of the connector of the invention may be partial regions of the ring-shaped chamfer, rounded face, or curved portion.

The terminals of the connector of the invention may any terminal adapted to be held in the body and connected to connection means (to be described) of the mating connector. The electronic component of the connector of the invention may be omitted. Alternatively, the electronic component of the invention may be any electrical component for automobile other than a camera unit, or any other electronic component. The electronic component may be a camera, a microphone, a loudspeaker, a sensor, a switch, a microphone unit, a loudspeaker unit, a sensor unit, or a switch unit.

The case of the invention may be of any configuration if they meet the following conditions. First, the case has a through hole of larger dimensions than the outer dimensions of the tube so as to receive the tube of a mating connector. Second, the case can house the circuit board and the connector mounted thereon. If the through hole is polygonal tuboid having a plurality of inner walls, the first and second inner walls of the case of the invention may he opposed inner walls in the second direction. If the through hole is circular tuboid having a circular tuboid inner wall, the first and second inner walls of the invention may be opposed portions in the second direction of the inner wall. Similarly, the third and fourth inner walls of the case of the invention may be opposed inner walls in the second direction of the polygonal tuboid through hole, or alternatively opposed portions in the second direction of the inner wall of the circular tuboid through hole.

The relative positioning of the first inner wall and the second guide and of the second inner wall and the first guide may be modified to such that when a portion on the side of the first inner wall of the tube of the mating connector abuts the first inner wall, a portion on the side of the second inner wall of the tube will not be located on the second guide, and when a portion on the side of the second inner wall of the tube of the mating connector abuts the second inner wall, a portion on the side of the first inner wall of the tube will not be located on the first guide. Alternatively, the relative positioning of the first inner wall and the second guide and of the second inner wall and the first guide may be modified to such that when a portion on the side of the first inner wall of the tube of the mating connector abuts the first inner wall, a portion on the side of the second inner wall of the tube can be located on the second guide, and when a portion on the side of the second inner wall of the tube of the mating connector abuts the second inner wall, a portion on the side of the first inner wall of the tube will not be located on the first guide. It should be appreciated that the first guide may be a guide of any aspect described above that is located on the side of the first inner wall. The second guide may be a guide of any aspect described above that is located on the side of the second inner wall.

The relative positioning of the third inner wall and the fourth guide and of the fourth inner wall and the third guide may be modified to such that when a portion on the side of the third inner wall of the tube of the mating connector abuts the third inner wall, a portion on the side of the fourth inner wall of the tube will not be located on the fourth guide, and when a portion on the side of the fourth inner wall of the tube of the mating connector abuts the fourth inner wall, a portion on the side of the third inner wall of the tube will not be located on the third guide. Alternatively, the relative positioning of the third inner wall and the fourth guide and of the fourth inner wall and the third guide may be modified to such that when a portion on the side of the third inner wall of the tube of the mating connector abuts the third inner wall, a portion on the side of the fourth inner wall of the tube can be located on the fourth guide, and when a portion on the side of the fourth inner wall of the tube of the mating connector abuts the fourth inner wall, a portion on the side of the third inner wall of the tube will not be located on the third guide. It should be appreciated that the third guide may be a guide of any aspect described above that is located on the side of the third inner wall. The fourth guide may be a guide of any aspect described above that is located on the side of the fourth inner wall.

The mating connector of the invention may be any connector with a tube. For example, the mating connector may include a tube and connection means disposed inside the tube. The connection means may be one or more terminals, which may be configured like the terminals of Embodiment 1 or 2, or a circuit board, If the connection means is a circuit board, the circuit board may include a conductive part formed thereon for contact with the terminals of the module of the connector.

The tube of the mating connector of the invention may of any configuration adapted to fit with the connector of the module. For example, the tube of the mating connector may be of polygonal or circular tuboid shape. Further, the tube of the mating connector is not limited to part of a shield case, but may be a tube of insulating resin.

The fastening mechanism of the invention may be omitted. If omitted, the mating connector may be welded to the case of the module or fixed to the case with an adhesive. Alternatively, the fastening mechanism of the invention may be of any configuration adapted to fasten the mating connector to the case of the module with the connector of the module fitting with the tube of the mating connector. For example, the fastening mechanism may include a generally U-shaped plate spring. This spring may be adapted to receive the mating connector and the case of the module with the connector of the module fitting with the tube of the mating connector and thereby fasten the mating connector to the case of the module. The fastening mechanism may have same-sized engaging holes both on the mating connector side and the module side. Alternatively, the engaging holes on the mating connector side may be smaller in size than those on the module side. The engaging holes on either side of the fastening mechanism are not limited to circular holes. The engaging part of the fastening mechanism of the invention may be screws in place of the pins.

It should be appreciated that the embodiments and modifications thereof are described above by way of examples only. The materials, shapes, dimensions, numbers, arrangements, and other configurations of the constituents of the terminal and the connector of the invention may be modified in any manner if they can perform similar functions. The configurations of the embodiments and the modifications described above may be combined in any possible manner. The first direction of the invention may be any direction in which the mating connector is connected to the connector of the module. The second direction of the invention may be any direction substantially orthogonal to the first direction. The third direction of the invention may be any direction that is substantially orthogonal to the first direction and crosses the second direction.

REFERENCE SIGNS LIST

M: module
100: connector
  110: body
    110*a:* distal portion (distal portion of body)
    112*a*-112*h:* corner
    112*a*1-112*h*1: guide
    113*a,* 113*b:* holding holes
    114*a,* 114*b:* slit
  120: shell
    120*a:* lip
    121*a*-121*h:* corner
    122*a*-122*h:* guide
C: terminal
  C10: base
  C20: first arm
  C30: second arm
  C40: first contact portion
  C50: second contact portion
  C60: engaging portion
  C70: tail
200: circuit board
300: electronic component
400: case
  410: first case
    411: through-bole
      411*a*-411*d:* inner wall
  420: second case
500: packing
P: mating connector
10: molded part
20: body
30: terminal
40: shield case
  41: tube
    41*a* to 41*f:* wall
50: cable
R: fastening mechanism
413: engaging hole (first engaging hole)
11*a* engaging hole (second engaging hole)
R1: pin (engaging part)

The invention claimed is:

1. A module connectable to a math connector having a tube, the module comprising:
a case having a through hole of larger dimensions than outer dimensions of the tube so as to receive the tube;
a circuit board inside the case; and
a connector mounted on the circuit board and configured to fit into the tube along a first direction, the connector including a shell of tuboid shape, the shell including:
a lip;
a first corner where a distal face of the lip meets an outer face on one side of a second direction of the lip, the second direction being substantially orthogonal to the first direction;
a second corner where the distal face of the lip meets an outer face on the other side of the second direction of the lip;
a third corner where the distal face of the lip meets an outer face on one side of a third direction of the lip, the third direction being substantially orthogonal to the first direction and crossing the second direction;
a fourth corner where the distal face of the lip meets an outer face on the other side of the third direction of the lip; and
guides provided at the respective first, second, third, and fourth corners and located inside the through hole of the case, the guides each being at least one of a chamfer, a rounded face, and a curved portion curved inward of the connector.

2. The module according to claim 1, wherein
the case further includes first and second inner walls of the through hole that are opposed to each other in the second direction,
the guides of the shell include first and second guides,
the first guide is located on a side of the first inner wall, and the second guide is located on a side of the second inner wall, and
relative positioning of the first inner wall and the second guide is such that, when a portion on a side of the first inner wall of a tube of a mating connector abuts the first inner wall, a portion on a side of the second inner wall of the tube can be located on the second guide.

3. The module according to claim 2, wherein
the case further includes third and fourth inner walls of the through hole that are opposed to each other in the third direction,
the guides of the shell include further third and fourth guides,
the third guide is disposed on a side of the third inner wall, and the fourth guide is disposed on a side of the second inner wall, and
relative positioning of the third inner wall and the fourth guide is such that, when a portion on a side of the third inner wall of a tube of a mating connector abuts the third inner wall, a portion on a side of the fourth inner wall of the tube can be located on the fourth guide.

4. The module according to claim 1, wherein
the connector further includes a body fitting in the shell, the body including:
a distal portion located inside the through hole of the case;
a first corner where a distal face of the distal portion meets an outer ace on one side of the second direction of the distal portion;

a second corner where the distal face of the distal portion meets an outer face on the other side of the second direction of the distal portion;

a third corner where the distal face of the distal portion meets an outer face on one side of the third direction of the distal portion;

a fourth corner where the distal face of the distal portion meets an outer face on the other side of the third direction of the distal portion; and guides provided at the respective first, second, third, and fourth corners of the body, the guides of the body each being at least one of a chamfer, a rounded face, and a curved portion curved inward of the connector.

5. The module according to claim 1, further comprising a packing, the packing being provided at the case and configured to be interposed between the module and the mating connector.

6. The module according to claim 1, wherein the case further includes:

a first case having the through hole, and a second case welded to the first case.

7. The module according to claim 1, further comprising an electronic component mounted on the circuit board.

8. A connection structure of a module and a mating connector, the connection structure comprising:

the module according to claim 1; and a mating connector including a tube configured to be received in the through hole of the case of the module and to fit with the connector.

9. The connection structure according to claim 8, further comprising a fastening mechanism to fasten the mating connector to the case of the module with the connector fitting in the tube of the mating connector.

10. The connection structure according to claim 9, wherein the fastening mechanism includes:

a pair of first engaging holes in the case of the module;

a pair of second engaging holes in the mating connector, the second engaging holes communicating with the first engaging holes and being larger in size than the first engaging holes; and a pair of engaging parts configured to engage with the first and second engaging holes.

11. The connection structure according to claim 8, further comprising a packing configured to be interposed between the module and the mating connector.

12. A module connectable to a mating connector having a tube, the module comprising:

a case having a through hole of larger dimensions than outer dimensions of the tube so as to receive the tube;

a circuit board inside the case; and a connector mounted on the circuit board and configured to fit into the tube along a first direction, the connector including a body, the body including:

a distal portion;

a first corner where a distal face of the distal portion meets an outer face on one side of a second direction of the distal portion, the second direction being substantially orthogonal to the first direction;

a second corner where the distal face of the distal portion meets an outer face on the other side of the second direction of the distal portion;

a third corner where the distal face of the distal portion meets an outer face on one side of a third direction of the distal portion, the third direction being substantially orthogonal to the first direction and crossing the second direction;

a fourth corner where the distal face of the distal portion meets an outer face on the other side of the third direction of the distal portion; and guides provided at the respective first, second, third, and fourth corners and disposed inside the through hole of the case, the guides each being at least one of a chamfer, a rounded face, and a curved portion curved inward of the connector.

13. The module according to claim 12, wherein the case further includes first and second inner walls the through hole that are opposed to each other in the second direction, the guides of the body include first and second guides, the first guide is located on a side of the first inner wall, and the second guide is located on a side of the second inner wall, and relative positioning of the first inner wall and the second guide is such that, when a portion on a side of the first inner wall of a tube of a mating connector abuts the first inner wall, a portion on a side of the second inner wall of the tube can be located on the second guide.

14. The module according to claim 13, wherein the case further includes third and fourth inner walls of e h ugh hole that are opposed to each other in the third direction, the guides of the body include further third and fourth guides, the third guide is disposed on a side of the third inner wall, and the fourth guide is disposed on a side of the second inner wall, and relative positioning of the third inner wall and the fourth guide is such that, when a portion on a side of the third inner wall of a tube of a mating connector abuts the third inner wall, a portion on a side of the fourth inner wall of the tube can be located on the fourth guide.

15. The module according to claim 12, further comprising a packing, the packing being provided at the case and configured to be interposed between the module and the mating connector.

16. The module according to claim 12, wherein the case further includes:

a first case having the through hole, and a second case welded to the first case.

17. The module according to claim 12, further comprising an electronic component mounted on the circuit board.

18. A connection structure of a module and a mating connector, the connection structure comprising:

the module according to claim 12; and a mating connector including a tube configured to be received in the through hole of the case of the module and to fit with the connector.

19. The connection structure according to claim 18, further comprising a fastening mechanism to fasten the mating connector to the case of the module with the connector fitting in the tube of the mating connector.

20. The connection structure according to claim 19, wherein the fastening mechanism includes:

a pair of first engaging holes in the case of the module;

a pair of second engaging holes in the mating connector, the second engaging holes communicating with the first engaging holes and being larger in size than the first engaging holes; and a pair of engaging parts configured to engage with the first and second engaging holes.

21. The connection structure according to claim 18, further comprising a packing configured to be interposed between the module and the mating connector.

* * * * *